US005595608A

United States Patent [19]

Takebuchi et al.

[11] Patent Number: 5,595,608

[45] Date of Patent: Jan. 21, 1997

[54] PREPARATION OF PERMANENT MAGNET

[75] Inventors: Katashi Takebuchi, Ibaraki; Shinya Fujito; Shinya Hashimoto, both of Chiba; Koichi Yajima, Saitama, all of Japan

[73] Assignee: TDK Corporation, Tokyo, Japan

[21] Appl. No.: 333,982

[22] Filed: Nov. 2, 1994

[30] Foreign Application Priority Data

Nov. 2, 1993 [JP] Japan ..... 5-297300
Nov. 8, 1993 [JP] Japan ..... 5-302303

[51] Int. Cl.[6] ..... H01F 1/03

[52] U.S. Cl. ..... 148/104; 148/103; 419/12; 75/254; 75/255

[58] Field of Search ..... 419/12; 148/101, 148/104, 103; 75/254, 255

[56] References Cited

U.S. PATENT DOCUMENTS

| | | | |
|---|---|---|---|
| 4,853,045 | 8/1989 | Rozendaal | 148/104 |
| 4,968,347 | 11/1990 | Ramesh et al. | 419/12 |
| 5,049,335 | 9/1991 | Kuji et al. . | |
| 5,076,861 | 12/1991 | Kobayashi et al. . | |
| 5,281,250 | 1/1994 | Hamamura et al. | 75/255 |

FOREIGN PATENT DOCUMENTS

| | | |
|---|---|---|
| 0197712 | 10/1986 | European Pat. Off. . |
| 0216254 | 4/1987 | European Pat. Off. . |
| 0261579 | 3/1988 | European Pat. Off. . |
| 0557103 | 8/1993 | European Pat. Off. . |
| 0601943 | 6/1994 | European Pat. Off. . |
| 4027598 | 1/1992 | Germany . |
| 4-338607 | 11/1992 | Japan . |
| 5-21219 | 1/1993 | Japan . |

*Primary Examiner*—John Sheehan
*Attorney, Agent, or Firm*—Oblon, Spivak, McClelland, Maier & Neustadt, P.C.

[57] ABSTRACT

A permanent magnet which contains R, T and B as main ingredients wherein R is Y or a rare earth element and T is Fe or Fe and Co and has a primary phase of $R_2T_{14}B$ is produced by compacting a mixture of 60 to 95 wt % of a primary phase-forming master alloy and a grain boundary phase-forming master alloy both in powder form and sintering the compact. The primary phase-forming master alloy has columnar crystal grains of $R_2T_{14}B$ with a mean grain size of 3–50 μm and grain boundaries of an R rich phase and contains 26–32 wt % of R. The grain boundary phase-forming master alloy is a crystalline alloy consisting essentially of 32–60 wt % of R and the balance of Co or Co and Fe. In anther form, a permanent magnet which contains R, T and B as main ingredients wherein R is yttrium or a rare earth element, T is Fe or Fe+Co/Ni and has a primary phase of $R_2T_{14}B$ is produced by compacting a mixture of a primary phase-forming master alloy and a grain boundary-forming master alloy both in powder form and sintering the compact. The primary phase-forming master alloy has a primary phase of $R_2T_{14}B$ and grain boundaries of an R rich phase. The grain boundary-forming master alloy contains 40–65 wt % of R, 30–60 wt % of Fe, Co or Ni and 1–12 wt % of Sn, In or Ga.

38 Claims, 4 Drawing Sheets

PREPARATION OF PERMANENT MAGNET

BACKGROUND OF THE INVENTION

1. Field of the Invention

This invention relates to a method for preparing rare earth permanent magnets.

2. Prior Art

Rare earth magnets of high performance, typically powder metallurgical Sm—Co base magnets having an energy product of 32 MGOe have been produced on a large commercial scale. However, these magnets suffer from a problem that the raw materials, Sm and Co, cost much. Of rare earth elements, some elements of low atomic weight, e.g., Ce, Pr, and Nd are available in more plenty and less expensive than Sm. Iron is less expensive than cobalt. For these reasons, R-T-B base magnets (wherein R stands for a rare earth element and T stands for Fe or Fe plus Co) such as Nd—Fe—B and Nd—Fe—Co—B magnets were recently developed. One example is a sintered magnet as set forth in Japanese Patent Application Kokai (JP-A) No. 59-46008. Sintered magnets may be produced by applying a conventional powder metallurgical process for Sm—Co systems (melting→master alloy ingot casting→ingot crushing→fine pulverization→compacting→sintering→magnet), and excellent magnetic properties are readily available.

Generally, a master alloy ingot produced by casting has a structure wherein crystal grains made up of a ferromagnetic $R_2Fe_{14}B$ phase (referred to as a primary phase, hereinafter) are covered with a non-magnetic R-rich phase (referred to as a grain boundary phase, hereinafter). The master alloy ingot is then pulverized or otherwise reduced to a particle diameter smaller than the crystal grain diameter, offering a magnet powder. The grain boundary phase has a function to promote sintering by converting into a liquid phase and plays an important role for the sintered magnet to generate coercivity.

One typical method for the preparation of R-T-B sintered magnets is known as a two alloy route. The two alloy route is by mixing two alloy powders of different compositions and sintering the mixture, thereby improving magnetic properties and corrosion resistance. A variety of proposals have been made on the two alloy route. All these proposals use an alloy powder having approximately the same composition ($R_2T_{14}B$ ) as the primary phase of the final magnet and add a subordinate alloy powder thereto. The known subordinate alloys used heretofore include R rich alloys having a higher R content and a lower melting point than the primary phase (JP-A 4-338607 and U.S. Pat. No. 5,281,250 or JP-A 5-105915), $R_2T_{14}B$ alloys containing a different type of R from the primary phase (JP-A 61-81603), and alloys containing an intermetallic compound of R (JP-A 521219).

One of the alloys used in these two alloy methods is a primary alloy of the composition $R_2T_{14}B$. If the primary alloy is produced by a melt casting process, a soft magnetic α-Fe phase precipitates to adversely affect high magnetic properties. It is then necessary to carry out solution treatment, typically at about 900° C. or higher for one hour or longer. In JP-A 5-21219, for example, an $R_2T_{14}B$ alloy prepared by a high-frequency melting process is subject to solution treatment at 1070° C. for 20 hours. Because of such a need for high temperature, long time solution treatment, the melt casting method is against low cost manufacture. U.S. Pat. No. 5,281,250 produces an $R_2T_{14}B$ alloy by a direct reduction and diffusion process, which alloy has an isometric crystal system and poor magnetic properties. A higher calcium content also precludes manufacture of high performance magnets. JP-A 4-338607 uses a crystalline or amorphous $R_2T_{14}B$ alloy powder which is produced by a single roll process so as to have microcrystalline grains of up to 10 μm. It is not described that the grains are columnar. It is rather presumed that the grains are isometric because magnetic properties are low. JP-A 4-338607 describes that the grain size is limited to 10 μm or less in order to prevent precipitation of soft magnetic phases such as α-Fe.

With respect to thermal stability, R-T-B magnets are less stable than the Sm-Co magnets. For example, the R-T-B magnets have a differential coercivity $\Delta iHc/\Delta T$ as great as −0.60° to −0.55%/° C. in the range between room temperature and 180° C. and undergo a significant, irreversible demagnetization upon exposure to elevated temperatures. Therefore, the R-T-B magnets are rather impractical when it is desired to apply them to equipment intended for high temperature environment service, for example, electric and electronic devices in automobiles.

For reducing the irreversible demagnetization upon heating of R-T-B magnets, JP-A 62-165305 proposes to substitute Dy for part of Nd and Co for part of Fe. However, it is impossible to achieve a substantial reduction of $\Delta iHc/\Delta T$ by merely adding Dy and Co. Larger amounts of Dy substituted sacrifice maximum energy product (BH)max.

JP-A 64-7503 proposes to improve thermal stability by adding gallium (Ga) while IEEE Trans. Magn. MAG-26 (1990), 1960 proposes to improve thermal stability by adding molybdenum (Mo) and vanadium (V). The addition of Ga, Mo and V is effective for improving thermal stability, but sacrifices maximum energy product.

We proposed to add tin (Sn) and aluminum (Al) for improving thermal stability with a minimal loss of maximum energy product (JP-A 3-236202). Since the addition of Sn, however, still has a tendency of lowering maximum energy product, the amount of Sn added should desirably be limited to a minimal effective level.

It was also reported to add tin (Sn) to magnets using a so-called two alloy route. The two alloy route is by mixing two alloy powders of different compositions, typically an alloy powder having a composition approximate to the primary phase composition and a subordinate alloy powder having a composition approximate to the grain boundary phase composition and sintering the mixture. For instance, Proc. 11th Inter. Workshop on Rare-Earth Magnets and their Applications, Pittsburgh, 1990, p. 313 discloses that a sintered magnet is prepared by mixing $Nd_{14.5}Dy_{1.5}Fe_{75}AlB_8$ alloy powder with up to 2.5% by weight of $Fe_2Sn$ or CoSn powder, followed by sintering. It is reported that this sintered magnet has a $Nd_6Fe_{13}Sn$ phase precipitated in the grain boundary phase and is improved in thermal dependency of coercivity.

Making a follow-up experiment, we found that the $Fe_2Sn$ or CoSn material is unlikely to fracture and thus difficult to comminute into a microparticulate powder having a consistent particle size. Then sintered magnets resulting from a mixture of an R-T-B alloy powder and a $Fe_2Sn$ or CoSn powder contain unevenly distributed $Nd_6Fe_{13}Sn$ phase of varying size. This is also evident from FIG. 5 of the above-referred article. It is thus difficult to provide thermal stability in a consistent manner. Where tin is added in the form of $Fe_2Sn$ or CoSn powder, R and Fe in the primary phase are consumed to form $Nd_6Fe_{13}Sn$ , which can alter the composition of the primary phase, deteriorating magnetic properties.

SUMMARY OF THE INVENTION

An object of the present invention is to provide a method for producing an R-T-B system sintered permanent magnet at low cost in such a manner as to improve the magnetic properties thereof.

Another object of the present invention is to provide a method for producing an R-T-B system sintered permanent magnet in a consistent manner, the sintered magnet having good thermal stability and high magnetic properties, especially an increased maximum energy product.

In a first form of the present invention, there is provided a method for preparing a permanent magnet which contains R, T and B as main ingredients and has a primary phase consisting essentially of $R_2T_{14}B$. Herein R is at least one element selected from yttrium and rare earth elements, T is iron or a mixture of iron and cobalt, and B is boron. The method involves the steps of compacting a mixture of 60 to 95% by weight of a primary phase-forming master alloy and 40 to 5% by weight of a grain boundary phase-forming master alloy both in powder form and sintering the compact. The primary phase-forming master alloy contains columnar crystal grains consisting essentially of $R_2T_{14}B$ and having a mean grain size of 3 to 50 μm and grain boundaries composed primarily of an R rich phase having an R content higher than $R_2T_{14}B$. The primary phase-forming master alloy consists essentially of 26 to 32% by weight of R, 0.9 to 2% by weight of B, and the balance of T. The grain boundary phase-forming master alloy is a crystalline alloy consisting essentially of 32 to 60% by weight of R and the balance of cobalt or a mixture of cobalt and iron.

Preferably, the permanent magnet consists essentially of 27 to 32% by weight of R, 1 to 10% by weight of Co, 0,9 to 2% by weight of B, and the balance of Fe.

In one preferred embodiment, the primary phase-forming master alloy is produced by cooling an alloy melt from one direction or two opposite directions by a single roll, twin roll or rotary disk process; the primary phase-forming master alloy as cooled has a thickness of 0.1 to 2 mm in the cooling direction; the primary phase-forming master alloy is substantially free of an α-Fe phase.

In another preferred embodiment, the grain boundary phase-forming master alloy contains grains having a mean grain size of 0.1 to 20 μm; the grain boundary phase-forming master alloy is produced by cooling an alloy melt from one direction or two opposite directions by a single roll, twin roll or rotary disk process; the grain boundary phase-forming master alloy as cooled has a thickness of 0.1 to 2 mm in the cooling direction.

In a further preferred embodiment, the mixture contains the primary phase-forming master alloy and the grain boundary phase-forming master alloy which both in powder form have a mean particle size of 1 to 10 μm; the primary phase-forming master alloy in powder form is produced by causing the alloy to occlude hydrogen and pulverizing the alloy by a jet mill; the grain boundary phase-forming master alloy in powder form is produced by causing the alloy to occlude hydrogen and pulverizing the alloy by a jet mill. More preferably the alloys are heated to a temperature of 300° to 600° C., subjected to hydrogen occlusion treatment, and then pulverized without hydrogen release. The hydrogen occlusion may be optionally followed by hydrogen release.

The mixture is obtained in various ways, preferably by mixing the primary phase-forming master alloy and the grain boundary phase-forming master alloy, crushing the mixture, causing the mixture to occlude hydrogen, and milling the mixture by a jet mill; or by independently crushing the primary phase-forming master alloy and the grain boundary phase-forming master alloy, mixing the crushed alloys, causing the mixture to occlude hydrogen, and milling the mixture by a jet mill; or by independently crushing the primary phase-forming master alloy and the grain boundary phase-forming master alloy, independently causing the crushed alloys to occlude hydrogen, independently milling the alloys by a jet mill, and mixing the alloy powders.

The first form of the invention has the following advantages.

According to the invention, a sintered rare earth magnet is produced by a so-called two alloy route. The two alloy route for producing a sintered rare earth magnet involves compacting a mixture of a primary phase-forming master alloy and a grain boundary phase-forming master alloy both in powder form and sintering the compact.

The primary phase-forming master alloy used herein has columnar crystal grains, which are very small as defined by a mean grain size of 3 to 50 μm. The present invention limits the R content of the primary phase-forming master alloy to 26 to 32% by weight in order to establish a high residual magnetic flux density and improve corrosion resistance. Nevertheless, an R rich phase is well dispersed and an α-Fe phase is substantially absent. As a result, the magnet powder obtained by finely dividing the primary phase-forming master alloy has a minimal content of magnet particles free of the R rich phase, with substantially all magnet particles having an approximately equal content of the R rich phase. Then the powder can be effectively sintered and the dispersion of the R rich phase is well maintained during sintering so that high coercivity is expectable. Also the master alloy can be pulverized in a very simple manner to provide a sharp particle size distribution which insures a sufficient distribution of crystal grain size after sintering to develop high coercivity. A brief pulverization time reduces the amount of oxygen entrained, which is effective for achieving a high residual magnetic flux density. The particle size distribution becomes very sharp particularly when hydrogen occlusion assists in pulverization. The invention eliminates a need for solution treatment for extinguishing an α-Fe phase.

The present invention succeeds in further improving the magnetic properties of a sintered magnet when the grain boundary phase-forming master alloy has a grain size within the above-defined range.

Further improved magnetic properties are obtained when the primary phase and grain boundary phase-forming master alloys are produced by cooling respective alloy melts from one direction or two opposite directions by a single roll process or twin roll process such that the thickness in the cooling direction may fall within the above-defined range.

JP-A 4-338607 referred to above discloses that a crystalline or amorphous $Re_2TM_{14}B_1$ alloy powder having microcrystalline grains of up to 10 μm and an RE-TM alloy are produced by a single roll process. No reference is made to columnar grains, the thickness of alloy in the cooling direction, and the grain size of RE-TM alloy. As understood from the stoichiometric composition: $Re_2TM_{14}B_1$, the alloy is substantially free of a RE rich phase. Crystal grains in these alloys are regarded isometric as will be understood from Example 1 described later.

JP-A 62-216202 discloses a method for producing a R-T-B system magnet, using an alloy that has a macroscopically columnar structure in an ingot as cast. A short time of pulverization and an increased coercive force are described therein as advantages. The ingot has an arrangement of a surface chilled layer, a columnar grain layer and an internal isometric grain layer because of casting. The grain size is of much greater order than that defined in the present invention although the size of columnar structure is referred to nowhere in JP-A 62-216202. For this and other reasons, a coercive force of about 12 kOe is achieved at best. Manufacture of sintered magnets by the so-called two alloy route is referred to nowhere.

U.S. Pat. No. 5,049,335 discloses manufacture of a magnet by rapid quenching, but is silent about manufacture of a sintered magnet through a single or two alloy route using the quenched magnet as a master alloy. U.S. Pat. No. 5,076,861 discloses a magnet in the form of a cast alloy which has a grain size of much greater order than that defined in the present invention. The use of this cast alloy as a master alloy is referred to nowhere.

In a second form of the present invention, there is provided a method for preparing a permanent magnet which contains R, T and B as main ingredients and has a primary phase consisting essentially of $R_2T_{14}B$ . Herein R is at least one element selected from the group consisting of yttrium and rare earth elements, T is iron or a mixture of iron and at least one of cobalt and nickel, and B is boron. The method involves the steps of compacting a mixture of a primary phase-forming master alloy and a grain boundary-forming master alloy both in powder form and sintering the compact. The primary phase-forming master alloy has a primary phase consisting essentially of $R_2T_{14}B$ and grain boundaries composed mainly of an R rich phase having a higher R content than $R_2T_{14}B$ . The grain boundary-forming master alloy contains 40 to 65% by weight of R, 30 to 60% by weight of T' and 1 to 12% by weight of M. Herein T' is at least one element selected from the group consisting of iron, cobalt and nickel and M is at least one element selected from the group consisting of tin, indium and gallium. Preferably M contains 30 to 100% by weight of tin.

Preferably the permanent magnet consists essentially of 27 to 38% by weight of R, 0.5 to 4.5% by weight of B, 0.03 to 0.5% by weight of M, and 51 to 72% by weight of T. Preferably the permanent magnet contains an $R_6T'_{13}M$ phase in the grain boundary.

Preferably the mixture contains 99.2% to 90% by weight of the primary phase-forming master alloy and 0.2 to 10% by weight of the grain boundary-forming master alloy.

Preferably the grain boundary-forming master alloy has an $R_6T'_{13}M$ phase.

Preferably the primary phase of the primary phase-forming master alloy contains columnar crystal grains having a mean grain size of 3 to 50 μm.

In one preferred embodiment, the primary phase-forming master alloy is produced by cooling an alloy melt from one direction or two opposite directions by a single roll, twin roll or rotary disk process; the primary phase-forming master alloy as cooled has a thickness of 0.1 to 2 mm in the cooling direction; and the primary phase-forming master alloy is substantially free of an α-Fe phase.

In another preferred embodiment, the grain boundary phase-forming master alloy contains grains having a mean grain size of up to 20 μm; the grain boundary phase-forming master alloy is produced by cooling an alloy melt from one direction or two opposite directions by a single roll, twin roll or rotary disk process; and the grain boundary phase-forming master alloy as cooled has a thickness of 0.1 to 2 mm in the cooling direction.

In a further preferred embodiment, the primary phase-forming master alloy in powder form is produced by causing the alloy to occlude hydrogen and pulverizing the alloy by a jet mill; the grain boundary phase-forming master alloy in powder form is produced by causing the alloy to occlude hydrogen and pulverizing the alloy by a jet mill; and the alloys are heated to a temperature of 300° to 600° C., subjected to hydrogen occlusion treatment, and then pulverized without hydrogen release. The hydrogen occlusion may be optionally followed by hydrogen release.

The second form of the invention has the following advantages.

Regarding magnets prepared by sintering an R-T-B system alloy powder with Sn added thereto, we have found that the sintered magnets contain $R_6T_{13}Sn$ at the grain boundary, this $R_6T_{13}Sn$ created at the grain boundary is effective for improving thermal stability, and a tin residue in the primary phase contributes to a lowering of maximum energy product.

Accordingly, for the purpose of adding M to an R-T-B system magnet wherein M is at least one of Sn, In, and Ga, the present invention adopts a two alloy route and employs an M-containing alloy as the grain boundary-forming master alloy rather than adding M to the primary phase-forming master alloy. Since M is added to only the grain boundary-forming master alloy, satisfactory thermal stabilization is accomplished with minor amounts of M.

The present invention uses as the grain boundary-forming master alloy an alloy having a composition centering at $R_6T'_{13}M$ wherein T' is at least one of Fe, Co, and Ni. Unlike the $Fe_2Sn$ and CoSn alloys, the alloy of this composition is easy to pulverize so that it can be readily comminuted into a microparticulate powder, especially with the aid of hydrogen occlusion. As a consequence, the sintered magnet contains evenly distributed $R_6T'_{13}M$ phase of consistent size in the grain boundary. It is then possible to produce thermally stable magnets on a mass scale. In contrast, the aforementioned $Fe_2Sn$ and CoSn alloys are not fully milled even with the aid of hydrogen occlusion since little hydrogen can be incorporated therein. The use of an alloy having a composition centering at $R_6T'_{13}M$ as the grain boundary-forming master alloy allows the $R_6T'_{13}M$ phase to form in the grain boundary without substantial influence on the primary phase composition. This permits the magnet to exhibit magnetic properties inherent to the composition of the primary phase-forming master alloy without a loss.

When the grain boundary-forming master alloy has a grain size within the above-defined range, a finer powder is obtained, which ensures that the sintered magnet contains more evenly distributed $R_6T'_{13}M$ phase of more consistent size. Then the magnet has higher magnetic properties and higher thermal stability thereof. The grain boundary-forming master alloy having such a grain size can be prepared by a single or twin roll process, that is, by cooling an alloy melt from one direction or two opposite directions.

In general, the two alloy route uses an alloy having a composition approximate to $R_2T_{14}B$ as the primary phase-forming master alloy. If this alloy is prepared by a melt casting process, a magnetically soft α-Fe phase would precipitate to adversely affect magnetic properties. A solution treatment is then required. The solution treatment should be carried out at 900° C. or higher for one hour or longer. In JP-A 5-21219, for example, an $R_2T_{14}B$ alloy obtained by high-frequency induction melting is subject to solution treatment at 1070° C. for 20 hours. Due to a need for such high temperature, long term solution treatment, magnets cannot be manufactured at low cost with the melt casting process. If an $R_2Fe_{14}B$ alloy to be used in the two alloy route is prepared by a direct reduction and diffusion process as disclosed in JP-A 5-105915, the alloy has a too increased calcium content for magnets to have satisfactory properties In contrast, the preferred embodiment of the invention uses a primary phase-forming master alloy containing columnar grains having a mean grain size of 3 to 50 μm. This alloy has an R rich phase uniformly dispersed and is substantially free of an α-Fe phase. As a result, the magnet powder obtained by finely dividing the primary phase-forming master alloy has a minimal content of magnet particles free of the R rich phase, with substantially all magnet particles having an approximately equal content of the R rich phase. Then the powder can be effectively sintered and the dispersion of the R rich phase is well maintained during sintering so that high coercivity is expectable. Also the master alloy can be pulverized in a very simple manner to provide a sharp particle size distribution which insures a sufficient distribution of crystal grain size after sintering to develop high coercivity. A brief pulverization time reduces the amount of oxygen entrained, achieving a high residual magnetic flux density. The particle size distribution becomes very sharp particularly when hydrogen occlusion assists in pulverization. The invention eliminates a need for solution treatment for extinguishing an α-Fe phase.

Like the grain boundary-forming master alloy, the primary phase-forming master alloy can be prepared by a single or twin roll process, that is, by cooling an alloy melt from one direction or two opposite directions.

The above-referred JP-A 4-338607 discloses that a crystalline or amorphous $RE_2T_{14}B_1$ alloy powder having a fine grain size of up to 10 μm and a RE-T alloy are produced by a single roll process. However, no reference is made to the thickness of the alloy in the cooling direction and the grain size of the RE-T alloy. The RE-T alloy used therein has a composition different from the grain boundary-forming master alloy used in the present invention.

BRIEF DESCRIPTION OF THE DRAWINGS

For a better understanding of the present invention, the following description is made in conjunction with the accompanying drawings.

DETAILED DESCRIPTION OF THE INVENTION

First Form

Figure 1:
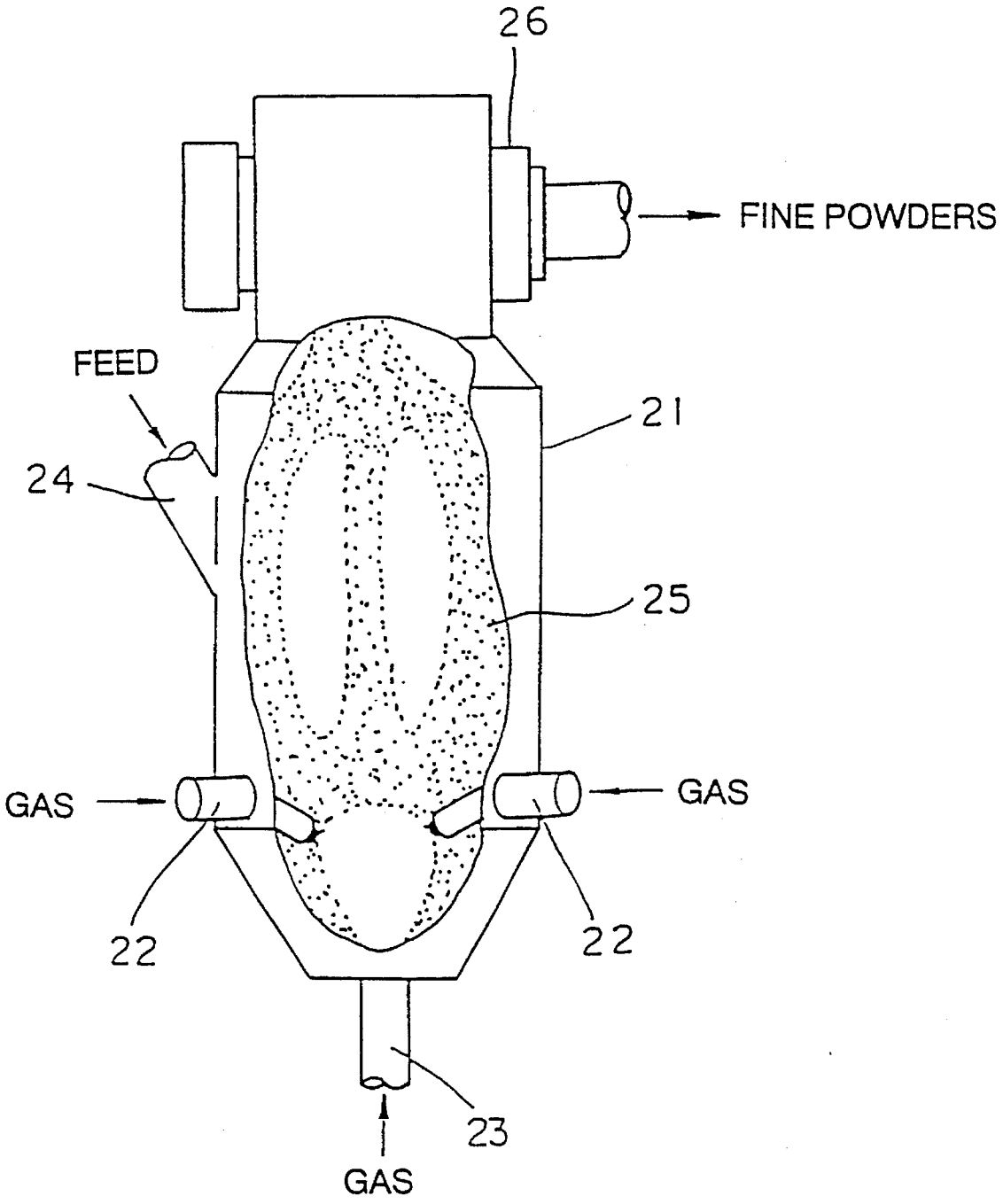
FIG. 1 is a partly cut-away, side view of a jet mill utilizing a fluidized bed.

According to the present invention, a sintered rare earth magnet is prepared by compacting a mixture of a primary phase-forming master alloy and a grain boundary phase-forming master alloy both in powder form and sintering the compact.

Primary Phase-Forming Master Alloy

The primary phase-forming master alloy contains R, T and B as main ingredients wherein R is at least one element selected from yttrium (Y) and rare earth elements, T is iron (Fe) or a mixture of iron and cobalt (Fe+Co), and B is boron. The alloy includes columnar crystal grains consisting essentially of tetragonal $R_2T_{14}B$ and grain boundaries composed mainly of an R rich phase having a higher R content than $R_2T_{14}B$.

The rare earth elements include lanthanides and actinides. At least one of Nd, Pr, and Tb is preferred, with Nd being especially preferred. Additional inclusion of Dy is preferred. It is also preferred to include at least one of La, Ce, Gd, Er, Ho, Eu, Pm, Tm, Yb, and Y. Mixtures of rare earth elements such as misch metal are exemplary sources.

In order to achieve a high residual magnetic flux density, the invention uses a primary phase-forming master alloy consisting essentially of 26 to 32% by weight of R, 0.9 to 2% by weight of B, and the balance of T.

A particular composition of the master alloy may be suitably determined in accordance with the target magnet composition while considering the composition of the grain boundary phase-forming master alloy and its mixing proportion. Although residual magnetic flux density increases with a decreasing R content, a low R content allows an iron rich phase such as an α-Fe phase to precipitate to adversely affect pulverization and magnetic properties. Also a reduced proportion of the R rich phase makes sintering difficult even after mixing with the grain boundary phase-forming master alloy, resulting in a low sintered density with no further improvement in residual magnetic flux density being expectable. Nevertheless, the present invention is successful in increasing the sintered density and substantially eliminating precipitation of an α-Fe phase even when the R content is as low as defined above. If R is less than 26% by weight, it is difficult to produce an acceptable magnet. An R content of more than 32% by weight fails to achieve a high residual magnetic flux density. A boron content of less than 0.9% by weight fails to provide high coercivity whereas a boron content of more than 2% by weight fails to provide high residual magnetic flux density. It is preferred to limit the content of cobalt (in T=Fe+Co) to 10% by weight or lower (based on the weight of the master alloy) in order to minimize a lowering of coercivity.

Additionally, an element selected from Al, Cr, Mn, Mg, Si, Cu, C, Nb, Sn, W, V, Zr, Ti, and Mo may be added in order to improve coercivity. The residual magnetic flux density will lower if the amount of such an additive element exceeds 6% by weight. In addition, the primary phase-forming master alloy may further contain incidental impurities or trace additives such as carbon and oxygen.

The primary phase-forming master alloy contains columnar crystal grains having a mean grain size of 3 to 50 μm, preferably 5 to 50 μm, more preferably 5 to 30 μm, most preferably 5 to 15 μm. If the mean grain size is too small, pulverizing of the alloy results in polycrystalline magnet particles, failing to achieve a high degree of orientation. If the mean grain size is too large, the advantages of the invention are not achieved.

It is to be noted that the mean grain size of columnar grains is determined by first cutting or polishing the master alloy to expose a section substantially parallel to the major axis direction of columnar grains, and measuring the width in a transverse direction of at least one hundred columnar grains in this section. The width measurements are averaged to give the mean grain size of columnar grains.

The columnar grains have an aspect ratio (defined as a major axis length to width ratio) which is preferably between about 2 and about 50, especially between about 5 and about 30 although it is not particularly limited.

The primary phase-forming master alloy has a good dispersion of an R rich phase, which can be observed in an electron microscope photograph (or reflection electron image).

The grain boundary composed mainly of the R rich phase usually has a width of about 0.5 to 5 μm although the width varies with the R content. R rich phase preferably exists in an amount of 1 to 10% by volume as observed under SEM.

Preferably, the primary phase-forming master alloy having such a structure is produced by cooling an alloy melt containing R, T and B as main ingredients from one or two opposite directions. The thus produced master alloy has columnar grains arranged such that their major axis is oriented in substantial alignment with the cooling direction. The term "cooling direction" used herein refers to a direction perpendicular to the surface of a cooling medium such as the circumferential surface of a chill roll, i.e., a heat transfer direction. For cooling the alloy melt in one direction, single roll and rotary disk techniques are preferably used.

The single roll technique is by injecting an alloy melt through a nozzle toward a chill roll for cooling by contact with the peripheral surface thereof. The apparatus used therein has a simple structure and a long service life and is easy to control the cooling rate. A primary phase-forming master alloy usually takes a thin ribbon form when produced by the single roll technique. Various conditions for the single roll technique are not critical. Although conditions can be suitably determined such that the primary phase-forming master alloy having a structure as mentioned above may be obtained, the following conditions are often used. The chill roll, for instance, may be made of various materials that are used for conventional melt cooling procedures, such as copper and copper alloys (e.g., Cu-Be alloys). An alternative chill roll is a cylindrical base of a material as mentioned just above which is covered with a surface layer of a metal material different from the base material. This surface layer is often provided for thermal conductivity control and wear resistance enhancement. For instance, when the cylindrical base is made of Cu or a Cu alloy and the surface layer is made of Cr, the primary phase-forming master alloy experiences a minimal differential cooling rate in its cooling direction, resulting in a more homogeneous master alloy. In addition, the wear resistance of Cr ensures that a larger quantity of master alloy is continuously produced with a minimal variation of properties.

The rotary disk technique is by injecting an alloy melt through a nozzle against a rotating chill disk for cooling by contact with the surface thereof. A primary phase-forming master alloy is generally available in scale or flake form when produced by the rotary disk technique. It is noted, however, that as compared with the single roll technique, the rotary disk technique involves some difficulty in achieving uniform cooling rates because master alloy flakes are more rapidly cooled at the periphery than the rest.

A twin roll technique is effective for cooling an alloy melt from two opposite directions. This technique uses two chill rolls, each being similar to that used in the single roll technique, with their peripheral surfaces opposed to each other. The alloy melt is injected between the opposed peripheral surfaces of the rotating rolls. A primary phase-forming master alloy is generally available in a thin ribbon or thin piece form when produced by the twin roll technique. Various conditions for the twin roll technique are not critical, and can be suitably determined such that the above-mentioned structure may be obtained.

Most preferred among these cooling techniques is the single roll technique. It is understood that the alloy melt is preferably cooled in a non-oxidizing atmosphere such as nitrogen and argon or in vacuum.

When a primary phase-forming master alloy is produced by cooling an alloy melt from one or two opposite directions, it preferably has a thickness of 0.1 to 2 mm, more preferably 0.2 to 1.0 mm and most preferably 0.2 to 0.5 mm as measured in the cooling direction. With a thickness of less than 0.1 mm, isometric grains are likely to form and columnar grains are unlikely to form. It would then be difficult to obtain columnar grains having a mean grain size of more than 3 μm. With a thickness exceeding 2 mm, the resulting structure would become more uneven in the cooling direction particularly when cooled from one direction. More particularly, since grains are sized too small on the cooling side, the alloy tends to form polycrystalline particles when pulverized, which would degrade sintered density and orientation, failing to provide satisfactory magnetic properties. With a too much thickness in the cooling direction, it would also be difficult to obtain columnar grains having a mean grain size of less than 50 μm. In this sense, the twin roll technique is effective for suppressing excess grain growth. When the melt is cooled in one or two directions, the columnar grains have a length coincident with the thickness of a thin ribbon or piece. The structure of the thin ribbon or piece consists essentially of columnar grains while isometric grains, if any, can exist only as chilled grains at the cooling surface and in an amount of less than 10%, especially 5% by volume as observed under SEM.

With such a cooling technique used, a primary phase-forming master alloy that is substantially free of an α-Fe phase can be produced even when the starting composition has a relatively low R content, for instance, an R content of about 26 to 32% by weight. More particularly, the content of α-Fe phase can be reduced to 5% by volume or less, especially 2% by volume or less. This eliminates a solution treatment for reducing the proportion of distinct phases.

Grain Boundary Phase-forming Master Alloy

The grain boundary phase-forming master alloy is a crystalline alloy consisting essentially of 32 to 60% by weight of R and the balance of cobalt or a mixture of cobalt and iron. An R content of less than 32% is less effective for promoting sintering whereas an R content of more than 60% forms instead of an R—Co compound, an R rich phase, especially a neodymium rich phase which would be oxidized during sintering, resulting in lower coercivity.

Cobalt is effective for improving the corrosion resistance of a magnet, but functions to lower the coercivity if it is contained in the primary phase of the magnet. For a sintered magnet, it is then preferred that cobalt be contained mainly in the grain boundary phase of the magnet. For this reason, cobalt is contained in the grain boundary phase-forming master alloy according to the present invention. Where the grain boundary phase-forming master alloy contains cobalt and iron, the iron proportion as expressed by Fe/(Co+Fe) should preferably be less than 71% by weight because too higher iron contents would adversely affect coercivity.

Additional elements such as Al, Si, Cu, Sn, Ga, V and In may be added to the grain boundary phase-forming master alloy, but their addition in excess of 5% by weight would invite a substantial loss of residual magnetic flux density. In addition, the grain boundary phase-forming master alloy may further contain incidental impurities or trace additives such as carbon and oxygen.

The grain boundary phase-forming master alloy mainly contains at least one of $R_3(Co,Fe)$, $R(Co,Fe)_5$, $R(Co,Fe)_3$, $R(Co,Fe)_2$, and $R_2(Co,Fe)_{17}$ phases while any of other R—(Co,Fe) phases may be optionally present. Preferably the grain boundary phase-forming master alloy contains columnar crystal grains having a mean grain size of 0.1 to 20 μm, more preferably 0.5 to 10 μm. With a too large mean grain size of more than 20 μm, the ferromagnetic $R_2(Co,Fe)_{17}$ phase would be increased to hinder comminution. When such a grain boundary phase-forming master alloy is mixed with a primary phase-forming master alloy and sintered into a magnet, the sintered magnet would be increased in crystal grain size to adversely affect magnetic properties, especially coercivity. If the mean grain size is less than 0.2 μm, the ferromagnetic $R_2(Co,Fe)_{17}$ phase would be decreased. Then a comminuted powder would become polycrystalline rather than monocrystalline, and it would then be difficult to provide good orientation during compacting, resulting in a magnet having poor magnetic properties, especially a low residual magnetic flux density.

The structure of the grain boundary phase-forming master alloy can be observed in an electron microscope photograph (or reflection electron image).

The grain boundary phase-forming master alloy may be produced by any desired method, for example, a conventional casting method. Preferably it is again produced by cooling an alloy melt from one direction or two opposite directions in the same manner as previously described for the primary phase-forming master alloy. Preferred conditions for such cooling techniques are the same as previously described for the primary phase-forming master alloy. The grain boundary phase-forming master alloy has a thickness in the cooling direction which falls in the same range as previously described for the primary phase-forming master alloy.

Pulverization and Mixing Steps

It is not critical how to produce a mixture of a primary phase-forming master alloy powder and a grain boundary phase-forming master alloy powder. Such a mixture is obtained in various ways, for example, by mixing the two master alloys, crushing the alloys together, and finely milling the alloys. Alternatively, a mixture is obtained by crushing the two master alloys separately, mixing the crushed alloys, and finely milling the mixture. A further alternative is by crushing and then finely milling the two master alloys separately, and mixing the milled alloys. The last-mentioned procedure of milling the two master alloys separately until mixing is difficult to reduce the cost because of complexity.

Where the grain boundary phase-forming master alloy is one produced by a single roll technique and having a small mean grain size, it is preferred to mix the two master alloys and to crush and then mill the alloys together because a uniform mixture is readily available. In contrast, where the grain boundary phase-forming master alloy used is one produced by a melting technique, the preferred procedure is by crushing the two master alloys separately, mixing the crushed alloys, and finely dividing the mixture or by crushing and then finely milling the two master alloys separately, and mixing the milled alloys. This is because the grain boundary phase-forming master alloy produced by a melting technique has a so large grain size that crushing the alloy together with the primary phase-forming master alloy is difficult.

The mixture contains 60 to 95% by weight, preferably 70 to 90% by weight of the primary phase-forming master alloy. Magnetic properties are insufficient if the content of the primary phase-forming master alloy is below the range whereas the benefits associated with the addition of the grain boundary phase-forming master alloy are more or less lost if the content of the primary phase-forming master alloy is above the range.

It is not critical how to pulverize the respective master alloys. Suitable pulverization techniques such as mechanical pulverization and hydrogen occlusion-assisted pulverization may be used alone or in combination. The hydrogen occlusion-assisted pulverization technique is preferred because the resulting magnet powder has a sharp particle size distribution.

Hydrogen may be occluded or stored directly into the master alloy in thin ribbon or similar form. Alternatively, the master alloy may be crushed by mechanical crushing means such as a stamp mill, typically to a mean particle size of about 10 to 500 μm before hydrogen occlusion. No special limitation is imposed on the conditions for hydrogen occlusion-assisted pulverization. Any of conventional hydrogen occlusion-assisted pulverization procedures may be used. For instance, hydrogen occlusion and release treatments are carried out at least once for each, and the last hydrogen release is optionally followed by mechanical pulverization.

It is also acceptable to heat a master alloy to a temperature in the range of 300° to 600° C., preferably 350 to 450° C., then carry out hydrogen occlusion treatment and finally mechanically pulverize the alloy without any hydrogen release treatment. This procedure can shorten the manufacturing time because the hydrogen release treatment is eliminated.

Where the primary phase-forming master alloy is subject to such hydrogen occlusion treatment, there is obtained a powder having a sharp particle size distribution. During hydrogen occlusion treatment of the primary phase-forming master alloy, hydrogen is selectively stored in the R rich phase forming the grain boundaries to increase the volume of the R rich phase to stress the primary phase, which then cracks from where it is contiguous to the R rich phase. Such cracks tend to propagate in layer form in a plane perpendicular to the major axis of the columnar grains. Within the primary phase in which little hydrogen is occluded, on the other hand, irregular cracks are unlikely to occur. This prevents the subsequent mechanical pulverization from generating finer and coarser particles, assuring a magnet powder having a uniform particle size. In contrast, isometric grain alloys are unsusceptible to such a mode of pulverization, resulting in poor magnetic properties.

Also the hydrogen occluded within the above-mentioned temperature range forms a dihydride of R in the R rich phase. The R dihydride is fragile enough to avoid generation of coarser particles.

If the primary phase-forming master alloy is at a temperature of less than 300° C. during hydrogen occlusion, much hydrogen would be stored in the primary phase too and, besides, the R of the R rich phase would form a trihydride, which reacts with $H_2O$, resulting in a magnet containing much oxygen. If the master alloy stores hydrogen at a temperature higher than 600° C., on the other hand, no R dihydride would then be formed.

Conventional hydrogen occlusion-assisted pulverization processes entailed a large quantity of finer debris which had to be removed before sintering. So a problem arose in connection with a difference in the R content of the alloy mixture before and after pulverization. The process of the invention substantially avoids occurrence of finer debris and thus substantially eliminates a shift in the R content before and after pulverization. Since hydrogen is selectively stored in the grain boundary, but little in the primary phase of the primary phase-forming master alloy, the amount of hydrogen consumed can be drastically reduced to about ⅙ of the conventional hydrogen consumption.

It is understood that hydrogen is released during sintering of the magnet powder.

In the practice of the invention, the hydrogen occlusion step is preferably carried out in a hydrogen atmosphere although a mix atmosphere additionally containing an inert gas such as He and Ar or another non-oxidizing gas is acceptable. The partial pressure of hydrogen is usually at about 0.05 to 20 atm., but preferably lies at 1 atm. or below, and the occlusion time is preferably about ½ to 5 hours.

For mechanical pulverization of the master alloy with hydrogen occluded, a pneumatic type of pulverizer such as a jet mill is preferably used because a magnet powder having a narrow particle size distribution is obtained.

Figure 2:
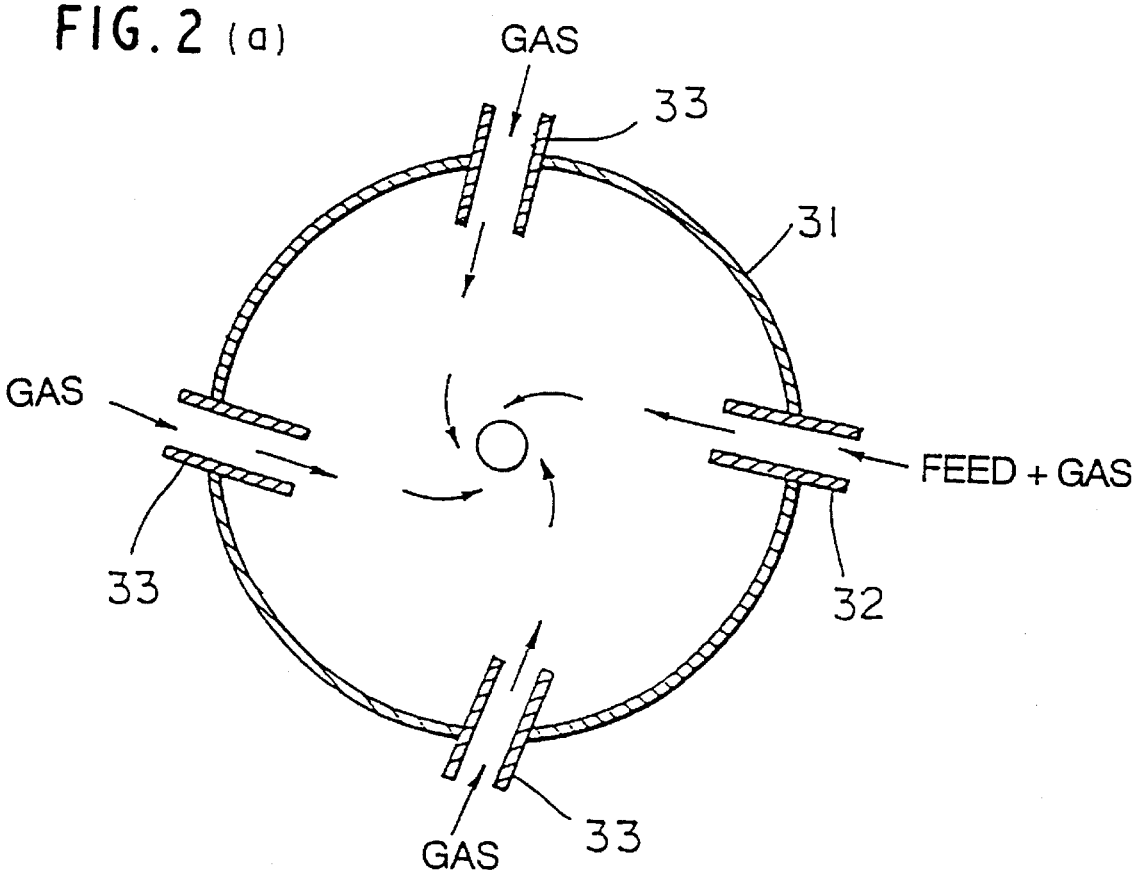
FIG. 2 illustrates a portion of a jet mill utilizing a vortex flow, FIG. 2*a* being a horizontal cross section and FIG. 2*b* being an elevational cross section.
Figure 2:
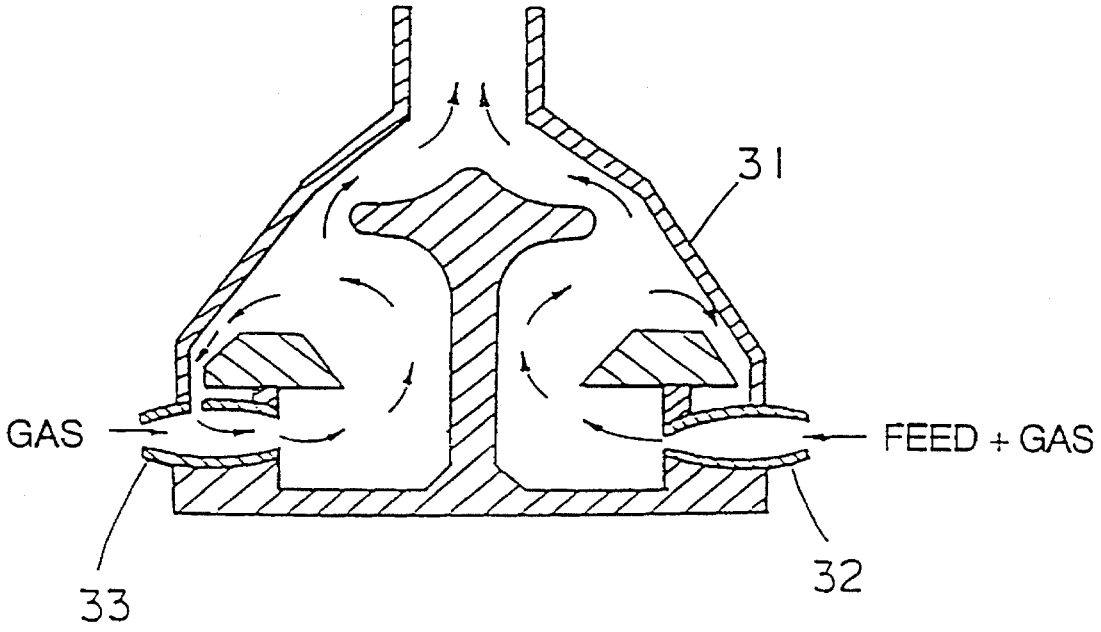
Figure 3:
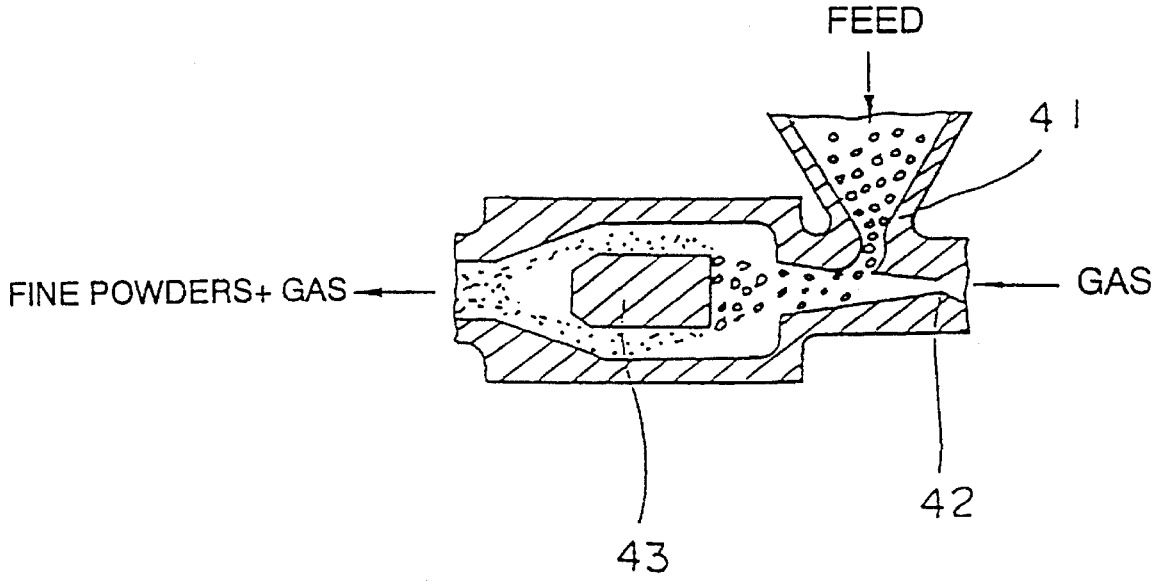
FIG. 3 is a cross-sectional view showing a portion of a jet mill utilizing an impingement plate.

The jet mills are generally classified into jet mills utilizing a fluidized bed, a vortex flow, and an impingement plate. FIG. 1 schematically illustrates a fluidized bed jet mill. FIG. 2 schematically illustrates a portion of a vortex flow jet mill. FIG. 3 schematically illustrates a portion of an impingement plate jet mill.

The jet mill of the structure shown in FIG. 1 includes a cylindrical vessel 21, a plurality of gas inlet pipes 22 extending into the vessel through the side wall thereof, and a gas inlet pipe 23 extending into the vessel through the bottom thereof wherein gas streams are introduced into the vessel 21 through the inlet pipes 22 and 23. A batch of feed or a master alloy having hydrogen occluded therein is admitted through a feed supply pipe 24 into the vessel 21. The gas streams cooperate with the admitted feed to form a fluidized bed 25 within the vessel 21. The alloy particles collide repeatedly with each other within the fluidized bed 25 and also impinge against the wall of the vessel 21, whereby they are milled or more finely pulverized. The thus milled fine particles are classified through a classifier 26 mounted on the vessel 21 before they are discharged out of the vessel 21. Relatively coarse particles, if any, are fed back to the fluidized bed 25 for further milling.

FIGS. 2*a* and 2*b* are horizontal and elevational cross-sectional views of the vortex flow jet mill. The jet mill of the structure shown in FIG. 2 includes a bottomed vessel 31 of a generally conical shape, a feed inlet pipe 32 and a plurality of gas inlet pipes 33 extending through the wall of the vessel in proximity to its bottom. Into the vessel 31, a batch of feed is supplied along with a carrier gas through the feed inlet pipe 32 , and a gas is injected through the gas inlet pipes 33. The feed inlet pipe 32 and gas inlet pipes 33 are located diagonally and at an angle with respect to the wall of the vessel 31 (as viewed in the plan view of FIG. 2*a*) so that the gas jets can form a vortex flow in the horizontal plane within the vessel 31 and create a fluidized bed owing to vertical components of kinetic energy. The feed master alloy particles collide repeatedly with each other within the vortex flow and fluidized bed in the vessel 31 and also impinge against the wall of the vessel 31 whereby they are milled or more finely pulverized. The thus milled fine particles are discharged out of the vessel 31 through an upper opening. Relatively coarse particles, if any, are classified within the vessel 31, then sucked into the gas inlet pipes 33 through holes in the side wall thereof, and injected again along with the gas jets into the vessel 31 for repeated pulverization.

In the jet mill having the structure shown in FIG. 3, a batch of feed is supplied through a feed hopper 41, accelerated by a gas jet admitted through a nozzle 42, and then impinged against an impingement plate 43 for milling. The milled feed particles are classified, and fine particles are discharged out of the jet mill. Relatively coarse particles, if any, are fed back to the hopper 41 for repeated pulverization in the same manner as mentioned above.

It is understood that the gas jets in the jet mill are preferably made of a non-oxidizing gas such as $N_2$ or Ar gas.

Preferably, the milled particles have a mean particle size of about 1 μm to about 10 μm.

Since the milling conditions vary with the size and composition of the master alloy, the structure of a jet mill used, and other factors, they may be suitably determined without undue experimentation.

It is to be noted that hydrogen occlusion can cause not only cracking, but also disintegration of at least part of the master alloy. When the master alloy after hydrogen occlusion is too large in size, it may be pre-pulverized by another mechanical means before pulverization by a jet mill.

Compacting Step

A mixture of primary phase-forming master alloy powder and grain boundary phase-forming master alloy powder is compacted, typically in a magnetic field. Preferably the magnetic field has a strength of 15 kOe or more and the compacting pressure is of the order of 0.5 to 3 t/cm$^2$.

Sintering Step

The compact is fired, typically at 1,000° to 1,200° C. for about ½ to 5 hours, and then quenched. It is noted that the sintering atmosphere comprises an inert gas such as Ar gas or vacuum. After sintering, the compact is preferably aged in a non-oxidizing atmosphere or in vacuum. To this end two stage aging is preferred. At the first aging stage, the sintered compact is held at a temperature ranging from 700° to 900° C. for 1 to 3 hours. This is followed by a first quenching step at which the aged compact is quenched to the range of room temperature to 200° C. At the second aging stage, the quenched compact is retained at a temperature ranging from 400° to 700° C. for 1 to 3 hours. This is followed by a second quenching step at which the aged compact is again quenched to room temperature. The first and second quenching steps preferably use a cooling rate of 10° C./min. or higher, especially 10° to 30° C./min. The heating rate to the hold temperature in each aging stage may usually be about 2° to 10° C./min. though not critical.

At the end of aging, the sintered body is magnetized if necessary.

Magnet Composition

The magnet composition is governed by the composition of primary phase-forming master alloy, the composition of grain boundary phase-forming master alloy, and the mixing ratio of the two alloys. The present invention requires that the respective master alloys have the above-defined composition and their mixing ratio fall in the above-defined range although it is preferred that the magnet as sintered have a composition consisting essentially of 27 to 32% by weight of R, 1 to 10% by weight of Co, 0.9 to 2% by weight of B, and the balance of Fe.

An R content within this range contributes to a high residual magnetic flux density and an acceptable sintered density. A boron content within this range contributes to a high residual magnetic flux density and high coercive force. A cobalt content within this range contributes to high corrosion resistance and minimizes a lowering of coercivity.

Second Form

According to the present invention, a sintered rare earth magnet is prepared by compacting a mixture of a primary phase-forming master alloy and a grain boundary phase-forming master alloy both in powder form and sintering the compact.

Primary Phase-Forming Master Alloy

The primary phase-forming master alloy contains R, T and B as main ingredients wherein R is at least one element selected from the group consisting of yttrium (Y) and rare earth elements, T is iron or a mixture of iron and cobalt and/or nickel (that is, T=Fe, Fe+Co, Fe+Ni, or Fe+Co+Ni), and B is boron. The alloy includes columnar crystal grains consisting essentially of tetragonal $R_2T_{14}B$ and grain boundaries composed mainly of an R rich phase having a higher R content than $R_2T_{14}B$.

The rare earth elements include lanthanides and actinides. At least one of Nd, Pr, and Tb is preferred, with Nd being especially preferred. Additional inclusion of Dy is preferred. It is also preferred to include at least one of La, Ce, Gd, Er, Ho, Eu, Pm, Tm, Yb, and Y. Mixtures of rare earth elements such as misch metal are exemplary sources.

The composition of the primary phase-forming master alloy is not critical insofar as the above-mentioned requirements are met. A particular composition of the master alloy may be suitably determined in accordance with the target magnet composition while considering the composition of the grain boundary phase-forming master alloy and its mixing proportion. Preferably the primary phase-forming master alloy consists essentially of 27 to 38% by weight of R, 0.9 to 2% by weight of B, and the balance of T.

Additionally, an element selected from Al, Cr, Mn, Mg, Si, Cu, C, Nb, W, V, Zr, Ti, and Mo may be added. A residual magnetic flux density will lower if the amount of such an additive element exceeds 6% by weight. In addition, the primary phase-forming master alloy may further contain incidental impurities or trace additives such as carbon and oxygen.

Preferably the primary phase-forming master alloy contains columnar crystal grains having a mean grain size of 3 to 50 μm, more preferably 5 to 50 μm, further preferably 5 to 30 μm, most preferably 5 to 15 μm. If the mean grain size is too small, magnet particles obtained by pulverizing the alloy would be polycrystalline and fail to achieve a high degree of orientation. If the mean grain size is too large, the advantages of the invention would not be fully achieved.

It is to be noted that the mean grain size of columnar grains is determined by first cutting or polishing the master alloy to expose a section substantially parallel to the major axis direction of columnar grains, and measuring the width in a transverse direction of at least one hundred columnar grains in this section. The width measurements are averaged to give the mean grain size of columnar grains.

The columnar grains have an aspect ratio (defined as a major axis length to width ratio) which is preferably between about 2 and about 50, especially between about 5 and about 30 though not limited thereto.

The primary phase-forming master alloy has a good dispersion of an R rich phase, which can be observed in an electron microscope photograph (or reflection electron image). The grain boundary composed mainly of the R rich phase usually has a width of about 0.5 to 5 μm in a transverse direction although the width varies with the R content.

Preferably, the primary phase-forming master alloy having such a structure is produced by cooling an alloy melt containing R, T and B as main ingredients from one or two opposite directions. The thus produced master alloy has columnar grains arranged such that their major axis is oriented in substantial alignment with the cooling direction. The term "cooling direction" used herein refers to a direction perpendicular to the surface of a cooling medium such as the circumferential surface of a chill roll, i.e., a heat transfer direction.

For cooling the alloy melt in one direction, single roll and rotary disk techniques are preferably used.

The single roll technique is by injecting an alloy melt through a nozzle toward a chill roll for cooling by contact with the peripheral surface thereof. The apparatus used therein has a simple structure and a long service life and is easy to control the cooling rate. A primary phase-forming master alloy usually takes a thin ribbon form when produced by the single roll technique. Various conditions for the single roll technique are not critical. Although the conditions can be suitably determined such that the primary phase-forming master alloy having a structure as mentioned above may be obtained, the following conditions are usually employed. The chill roll, for instance, may be made of various materials that are used for conventional melt cooling procedures, such as Cu and Cu alloys (e.g., Cu-Be alloys). An alternative chill roll is a cylindrical base of a material as mentioned just above which is covered with a surface layer of a metal material different from the base material. This surface layer is often provided for thermal conductivity control and wear resistance enhancement. For instance, when the cylindrical base is made of Cu or a Cu alloy and the surface layer is made of Cr, the primary phase-forming master alloy experiences a minimal differential cooling rate in its cooling direction, resulting in a more homogeneous master alloy. In addition, the wear resistance of Cr ensures that a larger quantity of master alloy is continuously produced with a minimal variation of properties.

The rotary disk technique is by injecting an alloy melt through a nozzle against a rotating chill disk for cooling by contact with the surface thereof. A primary phase-forming master alloy is generally available in scale or flake form when produced by the rotary disk technique. It is noted, however, that as compared with the single roll technique, the rotary disk technique involves some difficulty in achieving uniform cooling rates because master alloy flakes are more rapidly cooled at the periphery than the rest.

A twin roll technique is effective for cooling an alloy melt from two opposite directions. This technique uses two chill rolls, each being similar to that used in the single roll technique, with their peripheral surfaces opposed to each other. The alloy melt is injected between the opposed peripheral surfaces. A primary phase-forming master alloy is generally available in a thin ribbon or thin piece form when produced by the twin roll technique. Various conditions for the twin roll technique are not critical, and can be suitably determined such that the above-mentioned structure may be obtained.

Most preferred among these cooling techniques is the single roll technique.

It is understood that the alloy melt is preferably cooled in a non-oxidizing atmosphere such as nitrogen and argon or in vacuum.

When a primary phase-forming master alloy is produced by cooling an alloy melt from one or two opposite directions, it preferably has a thickness of 0.1 to 2 mm, more preferably 0.2 to 1.0 mm and most preferably 0.2 to 0.5 mm as measured in the cooling direction. With a thickness of less than 0.1 mm, it would be difficult to obtain columnar grains having a mean grain size of more than 3 μm. With a thickness exceeding 2 mm, the resulting structure would become more uneven in the cooling direction particularly when cooled from one direction. More particularly, since grains are sized too small on the cooling side, the alloy tends to form polycrystalline particles when pulverized, which would degrade sintered density and orientation, failing to provide satisfactory magnetic properties. With a too much thickness in the cooling direction, it would also be difficult to obtain columnar grains having a mean grain size of less than 50 μm.

With such a cooling technique used, a primary phase-forming master alloy that is substantially free of an α-Fe phase can be produced even when the starting composition has a relatively low R content, for instance, an R content of about 26 to 32% by weight. More particularly, the content of α-Fe phase can be reduced to less than 5% by volume, especially less than 2% by volume. This eliminates a solution treatment for reducing the proportion of distinct phases.

Grain Boundary Phase-Forming Master Alloy.

The grain boundary phase-forming master alloy contains R, T' and M wherein R is as defined above, T' is at least one element selected from the group consisting of iron (Fe), cobalt (Co) and nickel (Ni) and M is at least one element selected from the group consisting of tin (Sn), indium (In) and gallium (Ga). The master alloy consists essentially of 40 to 65% by weight of R, 30 to 60% by weight of T', and 1 to 12% by weight of M, preferably 50 to 60% by weight of R, 40 to 50% by weight of T', and 4 to 10% by weight of M.

A master alloy with a much higher R content is oxidizable and thus unsuitable as a starting source material. With a much higher T' content, magnetically soft distinct phases such as α-Fe precipitate to deteriorate magnetic properties. With a too lower R or T' content, formation of an $R_6T'_{13}M$ phase during sintering, which will be described later, alters the composition of the primary phase to deteriorate magnetic properties. The composition of the R component in the grain boundary-forming master alloy (that is, the proportion of yttrium and rare earth elements in the R component) is not particularly limited although it is preferably substantially the same as the composition of the R component in the primary phase-forming master alloy because it is then easy to control the final magnet composition.

Cobalt and nickel are effective for improving the corrosion resistance of a magnet, but functions to lower the coercivity if they are contained in the primary phase of the magnet. For a sintered magnet, it is then preferred that cobalt and nickel be contained mainly in the grain boundary phase of the magnet. For this reason, cobalt and/or nickel is contained in the grain boundary phase-forming master alloy according to the present invention.

Preferably M is tin (Sn). Preferably M contains 30 to 100% by weight of Sn.

Additional elements such as Al, Si, Cu, Nb, W, V and Mo may be added to the grain boundary phase-forming master alloy in an amount of up to 5% by weight for suppressing a substantial loss of residual magnetic flux density. In addition, the grain boundary phase-forming master alloy may further contain incidental impurities or trace additives such as carbon and oxygen.

The grain boundary phase-forming master alloy, when it is crystalline, generally comprises a mix phase which contains at least one of $R_6T'_{13}M$, $RT'_2$, $RT'_3$, $RT'_7$, and $R_5T'_{13}$ phases and may additionally contain any of other R-T' and R-T'-M phases. This does not depend on a preparation method. The $R_6T'_{13}M$ phase is of a body centered cubic system. The presence of respective phases can be confirmed by electron radiation diffractometry, for example, as described in J. Magnetism and Magnetic Materials, 101 (1991), 417–418.

In general, a plurality of phases as mentioned above are contained in the crystalline grain boundary-forming master alloy which is prepared by an arc melting method, high-frequency induction melting method, or rapid quenching method such as a single roll technique. The alloy is pulverized as such according to the present invention while it may be annealed for increasing the proportion of $R_6T'_{13}M$ phase or creating a $R_6T'_{13}M$ phase. This annealing may be effected at a temperature of about 600° to 900° C. for about 1 to 20 hours. Too high annealing temperatures would cause Nd to be dissolved whereas too low annealing temperatures would induce little change of the phase structure.

Preferably the grain boundary phase-forming master alloy contains columnar crystal grains having a mean grain size of up to 20 μm, more preferably up to 10 μm. With a too large mean grain size of more than 20 μm, the distribution of the above-mentioned phases would be non-uniform. Then the alloy is pulverized into particles which would have largely varying compositions. If a grain boundary phase-forming master alloy powder comprising such variable composition particles is mixed with a primary phase-forming master alloy powder, the composition would become non-uniform and precipitation of a $R_6T'_{13}M$ phase playing an important role in improving properties would be hindered. Additionally there would occur a region where the primary phase composition is altered by precipitation of a $R_6T'_{13}M$ phase, resulting in insufficient thermal stability and magnetic properties (coercivity and squareness ratio). The lower limit of the mean grain size is not specified. This means that an amorphous grain boundary-forming master alloy is acceptable. It is understood that if the mean grain size is too small, the alloy becomes too fragile so that a large amount of ultra-fine debris is generated upon pulverization. Such ultra-fine debris is difficult to recover. When a mixture of the two master alloys in crude powder form is finely milled, the percentage recovery of the grain boundary phase-forming master alloy is selectively reduced or varied. This would result in a shift of composition (a lowering of R or M content) and a variation thereof, which in turn, results in a lowering of thermal stability, coercivity and sintered density and a variation thereof. Therefore, the mean grain size may desirably be more than 0.1 μm, especially more than 0.5 μm depending on the pulverizing conditions.

The grain boundary phase-forming master alloy may be produced by any desired method, for example, a conventional casting method. Preferably it is again produced by cooling an alloy melt from one direction or two opposite directions in the same manner as previously described for the primary phase-forming master alloy. Preferred conditions for such cooling techniques are the same as previously described for the primary phase-forming master alloy. The grain boundary phase-forming master alloy has a thickness in the cooling direction which falls in the same range as previously described for the primary phase-forming master alloy.

Pulverization and Mixing Steps_

It is not critical how to produce a mixture of a primary phase-forming master alloy powder and a grain boundary phase-forming master alloy powder. Such a mixture is obtained, for example, by mixing the two master alloys, crushing the alloys at the same time, and finely milling the alloys. Alternatively, a mixture is obtained by crushing the two master alloys separately, mixing the crushed alloys, and finely milling the mixture. A further alternative is by crushing and then finely milling the two master alloys separately, and mixing the milled alloys. The last-mentioned procedure of milling the two master alloys separately before mixing is difficult to reduce the cost because of complexity.

Where the grain boundary phase-forming master alloy is one produced by a single roll technique and having a small mean grain size, it is preferred to mix the two master alloys and to crush and then mill the alloys together because a uniform mixture is readily available. In contrast, where the grain boundary phase-forming master alloy used is one produced by a melting technique, the preferred procedure is by crushing the two master alloys separately, mixing the crushed alloys, and finely milling the mixture or by crushing and then finely milling the two master alloys separately, and mixing the milled alloys. This is because the grain boundary phase-forming master alloy produced by a melting technique has a so large grain size that crushing the alloy together with the primary phase-forming master alloy is difficult.

Preferably the mixture contains 0.2 to 10% by weight, preferably 0.5 to 10% by weight of the grain boundary phase-forming master alloy. The advantages achieved by adding the grain boundary-forming master alloy would be lost if the content of the grain boundary-forming master alloy is too low. Magnetic properties, especially residual magnetic flux density are insufficient if the content is too high.

It is not critical how to pulverize the respective master alloys. Suitable pulverization techniques such as mechanical pulverization and hydrogen occlusion-assisted pulverization may be used alone or in combination. The hydrogen occlusion-assisted pulverization technique is preferred because the resulting magnet powder has a sharp particle size distribution. Hydrogen may be occluded or stored directly into the master alloy in thin ribbon or similar form. Alternatively, the master alloy may be crushed, typically to a mean particle size of about 15 to 500 μm by mechanical crushing means such as a stamp mill before hydrogen occlusion.

No special limitation is imposed on the conditions for hydrogen occlusion-assisted pulverization. Any of conventional hydrogen occlusion-assisted pulverization procedures may be used. For instance, hydrogen occlusion and release treatments are carried out at least once for each, and the last hydrogen release is optionally followed by mechanical pulverization.

It is also acceptable to heat a master alloy to a temperature in the range of 300° to 600° C., preferably 350° to 450° C., then carry out hydrogen occlusion treatment and finally mechanically pulverize the alloy without any hydrogen release treatment. This procedure can shorten the manufacturing time because the hydrogen release treatment is eliminated.

Where the primary phase-forming master alloy is subject to such hydrogen occlusion treatment, there is obtained a powder having a sharp particle size distribution. When the primary phase-forming master alloy is subject to hydrogen occlusion treatment, hydrogen is selectively stored in the R rich phase forming the grain boundaries to increase the volume of the R rich phase to stress the primary phase, which cracks from where it is contiguous to the R rich phase. Such cracks tend to propagate in layer form in a plane perpendicular to the major axis of the columnar grains. Within the primary phase in which little hydrogen is occluded, on the other hand, irregular cracks are unlikely to occur. This prevents the subsequent mechanical pulverization from generating finer and coarser particles, assuring a magnet powder having a uniform particle size.

Also the hydrogen occluded within the above-mentioned temperature range forms a dihydride of R in the R rich phase. The R dihydride is fragile enough to avoid generation of coarser particles.

If the primary phase-forming master alloy is at a temperature of less than 300° C. during hydrogen occlusion, much hydrogen is stored in the primary phase too and, besides, the R of the R rich phase forms a trihydride, which reacts with $H_2O$ , resulting in a magnet containing much oxygen. If the master alloy stores hydrogen at a temperature higher than 600° C., on the other hand, no R dihydride will then be formed.

Conventional hydrogen occlusion-assisted pulverization processes entailed a large quantity of finer debris which had to be removed before sintering. So a problem arose in connection with a difference in the R content of the alloy mixture before and after pulverization. The process of the invention substantially avoids occurrence of finer debris and thus substantially eliminates a shift in the R content before and after pulverization. Since hydrogen is selectively stored in the grain boundary, but little in the primary phase of the primary phase-forming master alloy, the amount of hydrogen consumed can be drastically reduced to about ⅙ of the conventional hydrogen consumption.

It is understood that hydrogen is released during sintering of the magnet powder.

Also in the hydrogen occlusion treatment of the grain boundary-forming master alloy, hydrogen occlusion causes the alloy to increase its volume and to crack so that the alloy may be readily pulverized.

In the practice of the invention, the hydrogen occlusion step is preferably carried out in a hydrogen atmosphere although a mix atmosphere additionally containing an inert gas such as He and Ar or another non-oxidizing gas is acceptable. The partial pressure of hydrogen is usually at about 0.05 to 20 atm., but preferably lies at 1 atm. or below, and the occlusion time is preferably about ½ to 5 hours.

For mechanical pulverization of the master alloy with hydrogen occluded, a pneumatic type of pulverizer such as a jet mill is preferably used because a magnet powder having a narrow particle size distribution is obtained.

The jet mills are generally classified into jet mills utilizing a fluidized bed, a vortex flow, and an impingement plate which are shown in FIGS. 1, 2 and 3, respectively. Since the jet mills of FIGS. 1 to 3 have been described in conjunction with the first form of the invention, their description is omitted herein for avoiding redundancy.

The milled particles preferably have a mean particle size of about 1 μm to about 10 μm.

Since the milling conditions vary with the size and composition of the master alloy, the structure of a jet mill used, and other factors, they may be suitably determined without undue experimentation.

It is to be noted that hydrogen occlusion can cause not only cracking, but also disintegration of at least some of the master alloy. When the master alloy after hydrogen occlusion is too large in size, it may be pre-pulverized by another mechanical means before pulverization by a jet mill.

Compacting Step

A mixture of primary phase-forming master alloy powder and grain boundary phase-forming master alloy powder is compacted, typically in a magnetic field. Preferably the magnetic field has a strength of 15 kOe or more and the compacting pressure is on the order of 0.5 to 3 $t/m^2$.

Sintering Step

The compact is fired, typically at 1,000° to 1,200° C. for about ½ to 5 hours, and then quenched. It is noted that the sintering atmosphere comprises an inert gas such as Ar gas or vacuum. After sintering, the compact is preferably aged in a non-oxidizing atmosphere or in vacuum. To this end two stage aging is preferred. At the first aging stage, the sintered compact is held at a temperature ranging from 700° to 900° C. for 1 to 3 hours. This is followed by a first quenching step at which the aged compact is quenched to the range of room temperature to 200° C. At the second aging stage, the quenched compact is retained at a temperature ranging from 500° to 700° to C. for 1 to 3 hours. This is followed by a second quenching step at which the aged compact is again quenched to room temperature. The first and second quenching steps preferably use a cooling rate of 10° C./min. or higher, especially 10 to 30° C./min. The heating rate to the hold temperature in each aging stage may usually be about 2° to 10° C./min. though not critical.

At the end of aging, the sintered body is magnetized if necessary.

Magnet Composition

The magnet composition is governed by the composition of primary phase-forming master alloy, the composition of grain boundary phase-forming master alloy, and the mixing ratio of the two alloys. The present invention requires that the primary phase-forming master alloy has the above-defined structure and the grain boundary-forming master alloy has the above-defined composition although it is preferred that the magnet as sintered have a composition consisting essentially of 27 to 38% by weight of R, 0.5 to 4.5% by weight of B, 0.03 to 0.5%, especially 0.05 to 0.3% by weight of M, and 51 to 72% by weight of T.

Residual magnetic flux density increases as the R content decreases. However, a too low R content would allow α-Fe and other iron rich phases to precipitate to adversely affect pulverization and magnetic properties. Also since a reduced proportion of an R rich phase renders sintering difficult, the sintered density becomes low and the residual magnetic flux density is no longer improved. In contrast, even when the R content is as low as 27% by weight, the present invention is successful in increasing the sintered density and eliminating substantial precipitation of an α-Fe phase. If the R content is below 27% by weight, however, it would be difficult to produce a useful magnet. A too high R content would adversely affect residual magnetic flux density. A too low boron content would adversely affect coercivity whereas a too high boron content would adversely affect residual magnetic flux density.

EXAMPLE

Examples of the present invention are given below by way of illustration and not by way of limitation. Example 1

By cooling an alloy melt having the composition consisting essentially of 28% by weight Nd, 1.2% by weight Dy, 1.2% by weight B and the balance of Fe by a single roll technique in an Ar gas atmosphere, there were produced a series of primary phase-forming master alloys in thin ribbon form which are reported as Nos. 1—1 to 1-7 in Table 1. Table 1 also reports the thickness of primary phase-forming master alloy in the cooling direction and the peripheral speed of the chill roll. The chill roll used was a copper roll.

For comparison purposes, an alloy melt having the composition of 26.3% Nd, 1.2% Dy, 1.2% B and the balance of Fe, in % by weight, was cooled in an argon atmosphere by a single roll technique, obtaining primary phase-forming master alloys in thin ribbon form which are reported as Nos. 1-8 and 1-9 in Table 1. Table 1 also reports the thickness of these primary phase-forming master alloys in the cooling direction and the peripheral speed of the chill roll. The chill roll used was a copper roll.

Figure 4:
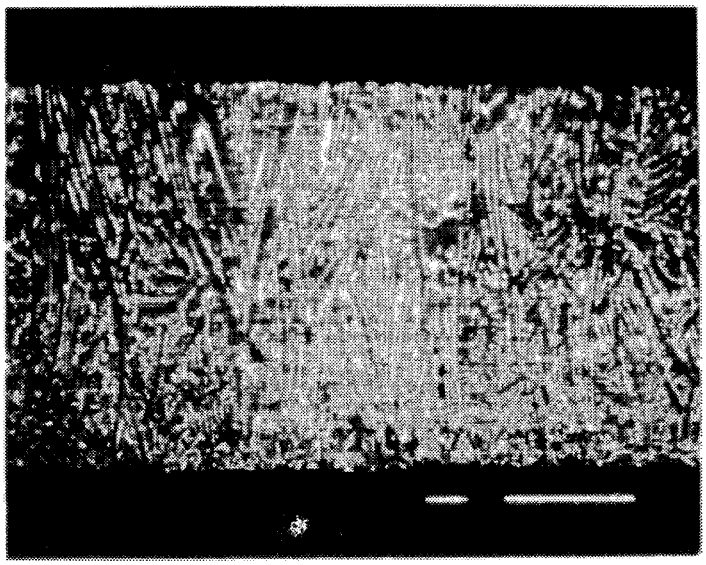
FIG. 4 is a photograph showing the columnar grain structure appearing in a section of a master alloy produced by a single roll technique.

Each master alloy was cut to expose a section including the cooling direction. The section was then polished for imaging under an electron microscope to take a reflection electron image. FIG. 4 is a photograph of sample No. 1-3 which indicates the presence of columnar crystal grains having a major axis substantially aligned with the cooling direction or the thickness direction of the thin ribbon. In some samples, isometric grains were also observed. For each master alloy, the mean grain size was determined by measuring the diameter of one hundred columnar grains across this section. Using scanning electron microscope/energy dispersive X-ray spectroscopy (SEM-EDX), each master alloy was examined for the presence of an α-Fe phase and isometric grains. The results are also reported in Table 1 . The amount of R rich phase of sample Nos. 1-2–1-4 are 1 to 10 vol %, however in example Nos. 1-8 and 1-9, R rich phase substantially did not exist.

Each primary phase-forming master alloy was crushed into a primary phase-forming master alloy powder having a mean particle size of 15 μm.

Separately, for sample Nos. 1—1 to 1-7 , an alloy having the composition consisting essentially of 38% by weight Nd, 1.2% by weight Dy, 15% by weight Co and the balance of Fe was melted by high-frequency induction in an argon atmosphere and cooled into an alloy ingot. This alloy ingot contained $R_3(Co,Fe)$, $R(Co,Fe)_5$, $R(Co,Fe)_3$, $R(Co,Fe)_2$, and $R_2(Co,Fe)_{17}$phases and had a mean grain size of 25 μm. The alloy ingot was crushed into a grain boundary phase-forming master alloy powder having a mean particle size of 15 μm.

For sample Nos. 1-8 and 1-9, a grain boundary phase-forming master alloy powder was prepared by the same procedure as above except that the starting alloy contained 43.8% by weight of Nd.

By mixing 80 parts by weight of the primary phase-forming master alloy powder and 20 parts by weight of the grain boundary phase-forming master alloy powder, there was obtained a mixture of the composition consisting essentially of 28.8% by weight Nd, 1.2% by weight Dy, 1% by weight B, 3% by weight Co, and the balance of Fe. The mixture was subject to hydrogen occlusion treatment under the following conditions and then to mechanical pulverization without hydrogen release treatment.

Hydrogen Occlusion Treatment Conditions

Mixture temperature: 400° C.

Treating time: 1 hour

Treating atmosphere: hydrogen atmosphere of 0.5 atm.

A jet mill configured as shown in FIG. 2 was used for mechanical pulverization. The mixture was milled until the respective alloy powders reached a mean particle size of 3.5 m.

The microparticulate mixture was compacted under a pressure of 1.5 t/cm$^2$ in a magnetic field of 15 kOe. The compact was sintered in vacuum at 1,075° C. for 4 hours and then quenched. The sintered body was subjected to two-stage aging in an argon atmosphere before a magnet was obtained. The first stage of aging was at 850° C. for 1 hour and the second stage of aging was at 520° C. for 1 hour.

The magnet was measured for magnetic properties which are reported in Table 1.

TABLE 1

| Master alloy No. | Roll periheral speed (m/s) | Thickness (mm) | Primary phase-forming master alloy: Columnar grain mean size (μm) | α-Fe (vol %) | Isometric grains (vol %) | Magnetic properties: Br (kG) | Hcj (kOe) | (BH) max (MGOe) |
|---|---|---|---|---|---|---|---|---|
| 1-1* | 0.5 | 0.52 | 100 | 7.0 | 0.0 | 13.4 | 12.1 | 42.7 |
| 1-2 | 1 | 0.35 | 30 | 3.8 | 0.0 | 13.6 | 14.0 | 43.8 |
| 1-3 | 2 | 0.29 | 10 | 2.4 | 0.0 | 13.6 | 14.6 | 44.2 |
| 1-4 | 4 | 0.23 | 5 | 1.2 | 4.3 | 13.5 | 15.0 | 43.5 |
| 1-5* | 6 | 0.15 | 2 | 0.3 | 14.8 | 13.1 | 15.4 | 40.8 |
| 1-6* | 10 | 0.09 | 0.5 | 0.0 | 27.6 | 12.8 | 15.8 | 38.3 |
| 1-7* | 30 | 0.03 | — | 0.0 | ≧95 | 9.7 | | |
| 1-8* | 4 | 0.23 | 5** | 1.2 | ≧95 | 12.9 | 13.5 | 39.5 |
| 1-9* | 6 | 0.15 | 2** | 0.3 | ≧95 | 11.8 | 13.9 | 33.1 |

*outside the scope of the invention
**mean grain size of isometric grains

It is evident from Table 1 that high performance magnets are obtained when the primary phase-forming master alloy contains columnar grains having a mean grain size of 3 to 50 μm. Those primary phase-forming master alloys substantially free of an R rich phase have relatively poor magnetic properties (Nos. 1-8 and 1-9).

Example 2

Magnet samples shown in Table 2 were prepared as follows.

Sample No. 2-1(Invention)

A primary phase-forming master alloy was prepared by cooling an alloy melt of the composition shown in Table 2 by a single roll technique as in Example 1. The chill roll was rotated at a peripheral speed of 4 m/s. The primary phase-forming master alloy was obtained in the form of a ribbon of 0.3 mm thick and 15 mm wide which was observed to contain columnar grains extending in the cooling direction and having a mean grain size of 5 μm. No α-Fe phase was observed. The alloy was crushed into a primary phase-forming master alloy powder having a mean particle size of 15 μm.

Separately, an alloy ingot was prepared by melting an alloy of the composition shown in Table 2 by high-frequency induction as in Example 1. This alloy ingot contained the same phases as the grain boundary phase-forming master alloy used in Example 1 and had a mean grain size of 25 μm. The alloy was crushed into a grain boundary phase-forming master alloy powder having a mean particle size of 15 μm.

The primary phase-forming master alloy powder and the grain boundary phase-forming master alloy powder were mixed in the weight ratio reported in Table 2° to form a mixture of the composition shown in Table 2 (the mixture's composition conforms to the magnet's composition). The mixture was milled as in Example 1. Thereafter it was compacted, sintered and aged as in Example 1, obtaining a magnet sample No. 2-1.

Sample 2-2(comparison)

This sample was manufactured by the same procedures as inventive sample No. 2-1 except that the primary phase-forming master alloy was prepared by high-frequency induction melting. This primary phase-forming master alloy contained an $R_2Fe_{14}B$ phase, a neodymium (Nd) rich phase, and an α-Fe phase, with the content of α-Fe phase being 10% by volume. Sample No. 2-3(Comparison).

This sample was manufactured by the same procedures as comparative sample No. 2-2 except that the primary phase-forming master alloy after high-frequency induction melting was subjected to solution treatment by heating at 900° C. for 24 hours in an argon atmosphere. No α-Fe phase was observed in the primary phase-forming master alloy as solution treated. Sample No. 2-4(Invention)

This sample was manufactured by the same procedures as inventive sample No. 2-1 except that the grain boundary phase-forming master alloy was prepared by a single roll technique in the same manner as the primary phase-forming master alloy of sample No. 2-1. The chill roll was rotated at a peripheral speed of 2 m/s for cooling the grain boundary phase-forming master alloy. The grain boundary phase-forming master alloy was obtained in the form of a ribbon of 0.2 mm thick and 15 mm wide which was observed to contain the same phases as in the grain boundary phase-forming master alloy of sample No. 2-1, but have a mean grain size of 3 μm.

Sample No. 2-5(Invention)

In preparing a grain boundary phase-forming master alloy, the peripheral speed of the chill roll was increased to 10 m/s to form a master alloy in amorphous state. Except for this change, a sample was manufactured by the same procedures as inventive sample No. 2-4.

Sample No. 2-6 (Comparison)

In preparing a primary phase-forming master alloy, the peripheral speed of the chill roll was increased to 10 m/s to form a master alloy in amorphous state. Except for this change, a sample was manufactured by the same procedures as inventive sample No. 2-4.

Sample No. 2-7 (Comparison)

An alloy melt of the same composition as the primary phase-forming master alloy of inventive sample No. 2-1 was cooled by a single roll technique to form ribbons of 0.3 mm thick and 15 mm wide. The chill roll was rotated at a peripheral speed of 2 m/s. The alloy was observed to contain columnar grains extending in the cooling direction and having a mean grain size of 9 μm. No α-Fe phase was observed. The alloy ribbons were crushed into an alloy powder having a mean particle size of 15 μm. The alloy powder was milled, compacted, sintered and aged in the same manner as inventive sample No. 2-1, obtaining a magnet.

Sample No. 2-8 (Comparison)

This sample was manufactured by the same procedures as inventive sample No. 2-1 except that the primary phase-forming master alloy and the grain boundary phase-forming master alloy had the compositions shown in Table 2.

Sample No. 2-9 (Comparison)

This sample was manufactured by the same procedures as comparative sample No. 2-8 except that the primary phase-forming master alloy was prepared by high-frequency induction melting in the same manner as comparative sample No. 2—2. The solution treatment was omitted from the primary phase-forming master alloy.

Sample No. 2-10 (Invention)

This sample was manufactured by the same procedures as inventive sample No. 2-4 except that the primary phase-forming master alloy and the grain boundary phase-forming master alloy had the compositions shown in Table 2.

Sample No. 2-11 (Comparison)

This sample was manufactured by the same procedures as inventive sample No. 2-1 except that a primary phase-forming master alloy of the same composition as the primary phase-forming master alloy of sample No. 2-1 was prepared by a direct reduction and diffusion (RD) method. Sample Nos. 2-12 to 2-18 (Invention)

Primary phase-forming master alloys in ribbon form were prepared by using Nd, Dy, Fe, Fe—B, Al, Fe—Nb, Fe—V, and Fe—W, all of 99.9% purity, and cooling in an argon atmosphere by a single roll process. Grain boundary phase-forming master alloys in ingot form were prepared by using Nd, Dy, Fe, Al, Sn, and Ga, all of 99.9% purity, and melting the components in an argon atmosphere by high frequency induction heating, followed by cooling. Except for these compositions, magnet samples were manufactured as in inventive sample No. 2-1.

Each of the magnet samples was determined for magnetic properties and corrosion resistance. The corrosion resistance was determined by keeping a sample in an atmosphere of 120° C., RH 100%, and 2 atm. for 100 hours, removing oxide from the sample surface, and measuring a weight loss from the initial weight. The value reported in Table 2 is a weight loss per unit surface area of the sample.

The results are shown in Table 2.

TABLE 2

| | | Master alloy and Magnet | | Mixing weight | Magnet properties | | | | |
|---|---|---|---|---|---|---|---|---|---|
| No. | Type | Method | Composition (wt %) | ratio | Br (kG) | Hcj (kOe) | (BH) max (MGOe) | corrosion resistance (mg/cm$^2$) | Remarks |
| 2-1 | P | 1-roll | 27.8Nd-1.2Dy-1.2B-bal.Fe | 80 | | | | | |
| | GB | Melting | 37.8Nd-1.2Dy-15Co-bal.Fe | 20 | | | | | |
| | Magnet | | 29.8Nd-1.2Dy-3.0Co-1.0B-bal.Fe | | 13.6 | 15.2 | 44.2 | 0.3 | |
| 2-2* | P | Melting | 27.8Nd-1.2Dy-1.1B-bal.Fe | 80 | | | | | |
| | GB | Melting | 37.8Nd-1.2Dy-15Co-bal.Fe | 20 | | | | | |
| | Magnet | | 29.8Nd-1.2Dy-3.0Co-1.0B-bal.Fe | | 12.5 | 13.2 | 38.1 | 0.3 | |
| 2-3* | P | Melting | 27.8Nd-1.2Dy-1.2B-bal.Fe | 80 | | | | | solution treated |
| | GB | Melting | 37.8Nd-1.2Dy-15Co-bal.Fe | 20 | | | | | |
| | Magnet | | 29.8Nd-1.2Dy-3.0Co-1.0B-bal.Fe | | 13.4 | 13.3 | 42.7 | 0.3 | |
| 2-4 | P | 1-roll | 27.8Nd-1.2Dy-1.2B-bal.Fe | 80 | | | | | |
| | GB | 1-roll | 37.8Nd-1.2Dy-15Co-bal.Fe | 20 | | | | | |
| | Magnet | | 29.8Nd-1.2Dy-3.0Co-1.0B-bal.Fe | | 13.6 | 16.4 | 44.6 | 0.3 | |
| 2-5 | P | 1-roll | 27.8Nd-1.2Dy-1.2B-bal.Fe | 80 | | | | | |
| | GB | 1-roll | 37.8Nd-1.2Dy-15Co-bal.Fe | 20 | | | | | amorphous |
| | Magnet | | 29.8Nd-1.2Dy-3.0Co-1.0B-bal.Fe | | 13.6 | 15.2 | 43.4 | 0.3 | |
| 2-6* | P | 1-roll | 27.8nD-1.2Dy-1.2B-bal.Fe | 80 | | | | | amorphous |
| | GB | 1-roll | 37.8Nd-1.2Dy-15Co-bal.Fe | 20 | | | | | |
| | Magnet | | 29.8Nd-1.2Dy-3.0Co-1.0B-bal.Fe | | 12.8 | 15.8 | 39.2 | 0.3 | |
| 2-7* | — | 1-roll | 29.8Nd-1.2Dy-3.0Co-1.0B-bal.Fe | 100 | | | | | |
| | Magnet | | 29.8Nd-1.2Dy-3.0Co-1.0B-bal.Fe | | 12.7 | 13.2 | 39.3 | 2.1 | |
| 2-8* | P | 1-roll | 33.8Nd-1.2Dy-1.2B-bal.Fe | 80 | | | | | |
| | GB | Melting | 38.8Nd-1.2Dy-15Co-bal.Fe | 20 | | | | | |
| | Magnet | | 34.8Nd-1.2Dy-3.0Co-1.0B-bal.Fe | | 11.7 | 14.5 | 32.5 | 2.1 | |
| 2-9* | P | Melting | 33.8Nd-1.2Dy-1.2B-bal.Fe | 80 | | | | | |
| | GB | Melting | 38.8Nd-1.2Dy-15Co-bal.Fe | 20 | | | | | |
| | Magnet | | 34.8Nd-1.2Dy-3.0Co-1.0B-bal.Fe | | 11.7 | 14.3 | 32.4 | 2.0 | |
| 2-10 | P | 1-roll | 26.0Nd-1.2Dy-1.2B-bal.Fe | 90 | | | | | |
| | GB | 1-roll | 49.0Nd-1.2Dy-15Co-bal.Fe | 10 | | | | | |
| | Magnet | | 28.3Nd-1.2Dy-3.0Co-1.0B-bal.Fe | | 14.2 | 14.0 | 47.5 | 0.1 | |
| 2-11* | P | RD | 27.8Nd-1.2Dy-1.2B-bal.Fe | 80 | | | | | |
| | GB | Melting | 37.8Nd-1.2Dy-15Co-bal.Fe | 20 | | | | | |
| | Magnet | | 29.8Nd-1.2Dy-3Co-0.3Al-1.0B-bal.Fe | | 12.8 | 15.2 | 39.9 | 0.5 | |
| 2-12 | P | 1-roll | 27.8Nd-1.0Dy-1.2B-0.4Al-bal.Fe | 80 | | | | | |
| | GB | Melting | 37.8Nd-5Dy-10Co-bal.Fe | 20 | | | | | |
| | Magnet | | 29.8Nd-1.2Dy-2Co-0.3Al-1.0B-bal.Fe | | 13.3 | 16.2 | 42.5 | 0.4 | |
| 2-13 | P | 1-roll | 27.8Nd-1.2Dy-1.2B-0.4Al-bal.Fe | 80 | | | | | |
| | GB | Melting | 37.8Nd-10Dy-15co-2Cu-bal.Fe | 20 | | | | | |
| | Magnet | | 29.8Nd-3.0Dy-3Co-0.3Al-0.4Cu-1.0B-bal.Fe | | 13.0 | 19.9 | 40.1 | 0.1 | |
| 2-14 | P | 1-roll | 27.8Nd-0.57-1.2b-bal.Fe | 80 | | | | | |
| | GB | Melting | 37.8Nd-8Dy-20Co-2Ga-bal.Fe | 20 | | | | | |
| | Magnet | | 29.8Nd-2.0Dy-4Co-0.4Ga-1.0B-bal.Fe | | 13.2 | 17.3 | 41.4 | 0.1 | |
| 2-15 | P | 1-roll | 27.8Nd-3.0Dy-1.2B-0.4Nb-bal.Fe | 80 | | | | | |
| | GB | Melting | 37.8Nd-13Dy-5Co-2Al-bal.Fe | 20 | | | | | |
| | Magnet | | 29.8Nd-5.0Dy-1Co-0.3Nb-0.4Al-1.0B-bal.Fe | | 12.4 | 24.8 | 36.5 | 0.4 | |
| 2-16 | P | 1-roll | 27.8Nd-2.0Dy-1.2B-0.4Al-bal.Fe | 80 | | | | | |
| | GB | Melting | 37.8Nd-20Dy-8Co-2Sn-bal.Fe | 20 | | | | | |
| | Magnet | | 29.8Nd-6.4Dy-1.6Co-0.3Al-0.4Sn-1.0B-bal.Fe | | 12.0 | 27.8 | 34.2 | 0.2 | |

TABLE 2-continued

| No. | Type | Master alloy and Magnet Method | Composition (wt %) | Mixing weight ratio | Magnet properties Br (kG) | Hcj (kOe) | (BH) max (MGOe) | corrosion resistance (mg/cm$^2$) | Remarks |
|---|---|---|---|---|---|---|---|---|---|
| 2-17 | P | 1-roll | 27.8Nd-0.4Dy-1.2B-0.4V-bal.Fe | 80 | | | | | |
| | GB | Melting | 37.8Nd-5Dy-25Co-bal.Fe | 20 | | | | | |
| | Magnet | | 29.8Nd-1.3Dy-5Co-0.3V-1.0B-bal.Fe | | 13.1 | 16.4 | 41.2 | 0.1 | |
| 2-18 | P | 1-roll | 27.8Nd-3.0Dy-1.2B-0.4W-bal.Fe | 80 | | | | | |
| | GB | Melting | 30.0Nd-1.2Dy-4Al-40Co-bal.Fe | 20 | | | | | |
| | Magnet | | 28.2Nd-2.6Dy-8Co-0.3W-0.8Al-1.0B-bal.Fe | | 12.3 | 18.2 | 35.9 | 0.1 | |

*comparison
P: primary phase-groming master alloy
GB: grain boundary phase-forming master alloy
1-roll: single roll method
RD: direct reduction and diffusion method The effectiveness of the invention is evident from these results of the Examples.

More specifically, inventive sample No. 2-1 had significantly better properties than comparative sample No. 2—2 wherein the primary phase-forming master alloy was prepared by a melting technique and comparative sample No. 2-3 wherein the primary phase-forming master alloy of sample No. 2—2 was subjected to solution treatment. Inventive sample No. 2-4 using the grain boundary phase-forming master alloy having grains of reduced size, due to a minimized variation in composition of the grain boundary phase-forming master alloy particles, achieved an improvement of about 8% in coercivity over sample No. 2-1 wherein the grain boundary phase-forming master alloy had a mean grain size of 25 μm and sample No. 2-5 wherein the grain boundary phase-forming master alloy was amorphous. Note that in sample No. 2-5 using amorphous grain boundary phase-forming master alloy, the crude powder mixture contained 29.8% by weight of Nd, but the Nd content decreased to 29.0% by weight at the end of milling.

Moreover, the samples falling within the scope of the invention had excellent magnetic properties and corrosion resistance as compared with sample No. 2-7 which did not used the two alloy route and sample Nos. 2-8 and 2-9 wherein the primary phase-forming master alloy had a greater R content than the range defined by the invention.

Example 3

Sample Nos. 3-1 to 3-14 (Invention)

Grain boundary-forming master alloys were prepared by using Nd, Fe, Co, Sn, Ga and In components, all of 99.9% purity, and arc melting the components in an argon atmosphere. Separately, primary phase-forming master alloys were prepared by using Nd, Dy, Fe, Co, Al, Si, Cu, ferroboron, Fe—Nb, Fe—W, Fe—V, and Fe—Mo components, all of 99.9% purity, and melting the components in an argon atmosphere by high-frequency induction heating. The compositions of the master alloys are shown in Table 1.

Each of the master alloys was independently crushed by a jaw crusher and brown mill in a nitrogen atmosphere. A crude powder of grain boundary-forming master alloy and a crude powder of primary phase-forming master alloy were mixed in a nitrogen atmosphere. The mixing proportion (weight ratio) and the composition of the resulting mixture (which conforms to the magnet's composition) are shown in Table 3. Next, the mixture was finely comminuted to a particle size of 3 to 5 μm by means of a jet mill using high pressure nitrogen gas jets. The microparticulate mixture was compacted under a pressure of 1.5 t/cm$^2$ in a magnetic field of 12 kOe. The compact was sintered in vacuum at 1,080° C. for 4 hours and then quenched. The sintered body was subjected to two-stage aging in an argon atmosphere. The first stage of aging was at 850° C. for 1 hour and followed by cooling at a rate of 15° C./min. The second stage of aging was at 620° C. for 1 hour and followed by cooling at a rate of 15° C./min. At the end of aging, the sintered body was magnetized, yielding a magnet sample.

Each magnet sample was measured for magnetic properties including coercivity Hcj, maximum energy product (BH)max, and dHcj/dT in the temperature range between 25° C. and 180° C. using a BH tracer and vibrating sample magnetometer (VSM).

Separately, each sample was processed so as to have a permiance coefficient of 2, magnetized in a magnetic field of 50 kOe, kept in a constant temperature tank for 2 hours, and cooled down to room temperature. Using a flux meter, the sample was measured for irreversible demagnetization. The temperature at which the irreversible demagnetization reached 5%, T (5%), was determined.

The results are shown in Table 3.

TABLE 3

| No. | Type | Master alloy and Magnet Composition (wt %) | Mixing weight ratio | Magnet properties Hcj (kOe) | (BH) max (MGOe) | T (5%) (°C.) | dHcj/dT (%/°C.) |
|---|---|---|---|---|---|---|---|
| 3-1 | P | 25.2Nd-7.2Dy-0.4Al-1.1B-bal.Fe | 100 | | | | |
| | GB | 50.5Nd-42.5Fe-7.0Sn | 4 | | | | |
| | Magnet | 26.0Nd-7.0Dy-0.4Al-1.1B-0.2Sn-bal.Fe | | 27 | 34 | 260 | −0.42 |
| 3-2 | P | 25.8Nd-7.2Dy-0.4Al-1.1B-bal.Fe | 100 | | | | |
| | GB | 50.5Nd-42.5Fe-7.0Sn | 2 | | | | |
| | Magnet | 26.0Nd-7.0Dy-0.4Al-1.1B-0.1Sn-bal.Fe | | 27 | 35 | 260 | −0.42 |

TABLE 3-continued

| No. | Type | Master alloy and Magnet Composition (wt %) | Mixing weight ratio | Magnet properties Hcj (kOe) | (BH) max (MGOe) | T (5%) (°C.) | dHcj/dT (%/°C.) |
|---|---|---|---|---|---|---|---|
| 3-3 | P | 25.8Nd-7.2Dy-0.4Al-1.1B-1.0Co-bal.Fe | 100 | | | | |
| | GB | 50.5Nd-42.5Fe-7.0Sn | 2 | | | | |
| | Magnet | 26.0Nd-7.0Dy-0.4Al-1.1B-0.1Sn-1.0Co-bal.Fe | | 26 | 35 | 260 | −0.42 |
| 3-4 | P | 25.8Nd-7.2Dy-0.4Al-1.1B-bal.Fe | 100 | | | | |
| | GB | 50.5Nd-42.5Co-7.0Sn | 2 | | | | |
| | Magnet | 26.0Nd-7.0Dy-0.4Al-1.1B-0.1Sn-1.0Co-bal.Fe | | 26 | 35 | 260 | −0.42 |
| 3-5 | P | 25.8Nd-7.0Dy-0.4Al-1.1B-bal.Fe | 100 | | | | |
| | GB | 45.0Nd-43.0Fe-12.0Sn | 1 | | | | |
| | Magnet | 26.0Nd-7.0Dy-0.4Al-1.1B-0.1Sn-bal.Fe | | 26 | 33 | 250 | −0.44 |
| 3-6 | P | 24.0Nd-7.6Dy-0.4Al-1.2B-bal.Fe | 100 | | | | |
| | GB | 50.5Nd-44.0Fe-5.5Sn | 8 | | | | |
| | Magnet | 26.0Nd-7.0Dy-0.4Al-1.1B-0.4Sn-bal.Fe | | 26 | 32 | 260 | −0.42 |
| 3-7 | P | 25.8Nd-7.2Dy-0.4Al-1.1B-bal.Fe | 100 | | | | |
| | GB | 50.5Nd-42.5Fe-3.5Sn-5.5Ga | 2 | | | | |
| | Magnet | 26.0Nd-7.0Dy-0.4Al-1.1B-0.5Sn-0.1Ga-bal.Fe | | 26 | 33 | 260 | −0.42 |
| 3-8 | P | 25Nd-7.2Dy-0.4Al-1.1B-bal.Fe | 100 | | | | |
| | GB | 50.5Nd-42.5Fe-3.5Sn-5.5In | 2 | | | | |
| | Magnet | 26.0Nd-7.0Dy-0.4Al-1.1B-0.05Sn-0.1In-bal.Fe | | 26 | 33 | 260 | −0.42 |
| 3-9 | P | 25.8Nd-7.2Dy-0.3Si-1.1B-bal.Fe | 100 | | | | |
| | GB | 50.5Nd-42.5Fe-7.0Sn | 2 | | | | |
| | Magnet | 26.0Nd-7.0Dy-0.3Si-1.0B-0.1Sn-bal.Fe | | 25 | 34 | 240 | −0.43 |
| 3-10 | P | 26.0Nd-7.0Dy-0.4Al-0.3Cu-1.1B-bal.Fe | 100 | | | | |
| | GB | 50.5Nd-42.5Fe-7.0Sn | 2 | | | | |
| | Magnet | 26.2Nd-6.9Dy-0.4Al-0.2Cu-1.0B-0.1Sn-bal.Fe | | 26 | 34 | 250 | −0.42 |
| 3-11 | P | 25.8Nd-7.2Dy-0.4Al-0.2Nb-1.1B-bal.Fe | 100 | | | | |
| | GB | 50.5Nd-42.5Fe-7.0Sn | 2 | | | | |
| | Magnet | 26.0Nd-7.0Dy-0.4Al-0.2Nb-1.1B-0.1Sn-bal.Fe | | 26 | 33 | 260 | −0.43 |
| 3-12 | P | 26.2Nd-6.8Dy-1.5W-1.1B-bal.Fe | 100 | | | | |
| | GB | 50.5Nd-42.5Co-7.0Sn | 2 | | | | |
| | Magnet | 26.2Nd-6.7Dy-1.5W-1.0B-0.1Sn-bal.Fe | | 25 | 34 | 260 | −0.42 |
| 3-13 | P | 26.0Nd-7.0Dy-1.2V-1.3B-bal.Fe | 100 | | | | |
| | GB | 50.5Nd-42.5Fe-7.0Sn | 2 | | | | |
| | Magnet | 26.2Nd-6.8Dy-1.2V-1.3B-0.1Sn-bal.Fe | | 26 | 35 | 260 | −0.42 |
| 3-14 | P | 25.8Nd-7.2Dy-0.4Al-1.0Mo-1.2B-bal.Fe | 100 | | | | |
| | GB | 50.5Nd-42.5Fe-7.0Sn | 2 | | | | |
| | Magnet | 26.0Nd-7.0Dy-0.4Al-1.0Mo-1.2B-0.4Sn-bal.Fe | | 26 | 34 | 260 | −0.42 |
| 3.15 | P | 25.2Nd-7.2Dy-1.1B-bal.Fe | 100 | | | | |
| | GB | 50.5Nd-42.5Fe-7.0Sn | 2 | | | | |
| | Magnet | 26.0Nd-7.0Dy-1.1B-0.1Sn-bal.Fe | | 25 | 35 | 260 | −0.42 |

Example 4 (Comparison)

Sample Nos. 4-1 to 4-4(Comparison)

Magnet-forming master alloys of the composition shown in Table 4 were prepared by the same procedure as used for the primary phase-forming master alloy of the inventive samples.

Like the inventive samples, the magnet-forming master alloys were crushed, finely milled, compacted, sintered, aged, and magnetized, obtaining magnet samples. These samples were similarly measured for magnetic properties. The results are shown in Table 4.

A comparison of sample No. 3-1 with No. 4-3 , a comparison of sample No. 3-2 with No. 4-2, and a comparison of sample Nos. 3-3 and 3-4 with No. 4-4 reveal that the inventive samples have at least equal thermal stability even when their Sn content is one-half of that of the comparative samples and better magnetic properties are obtained due to the reduced Sn content. A comparison of sample No. 3-1 with No. 4-2 reveals that for the same Sn content, the inventive sample is improved in thermal stability and magnetic properties. A comparison of sample No. 3-2 with No. 3-5 reveals that thermal stability and magnetic

TABLE 4

| No. | Type | Magnet Composition (wt %) | Magnet properties Hcj (kOe) | (BH) max (MGOe) | T (5%) (°C.) | dHcj/dT (%/°C.) |
|---|---|---|---|---|---|---|
| 4-1* | Magnet | 26.0Nd-7.0Dy-0.4Al-1.1B-bal.Fe | 30 | 33 | 200 | −0.55 |
| 4-2* | Magnet | 26.0Nd-7.0Dy-0.4Al-1.1B-0.2Sn-bal.Fe | 27 | 32 | 250 | −0.43 |
| 4-3* | Magnet | 26.0Nd-7.0Dy-0.4Al-1.1B-0.4Sn-bal.Fe | 26 | 30 | 260 | −0.42 |
| 4-4* | Magnet | 26.0Nd-7.0Dy-0.4Al-1.1B-0.2Sn-1.0Co-bal.Fe | 25 | 32 | 260 | −0.42 |
| 4-5* | Magnet | 26.0Nd-7.0Dy-1.1B-0.4Sn-bal.Fe | 25 | 32 | 250 | −0.43 |

*comparison properties are improved as the composition of the grain boundary-forming master alloy is closer to $R_6T'_{13}M$. It is understood that sample No. 3-2 uses a grain boundary-forming master alloy of the composition: 50.5Nd-42.5Fe-7.0Sn (% by weight) which corresponds to $Nd_6Fe_{13}Sn$ as expressed in atomic ratio. A comparison of sample No. 3-6 with No. 4-3 reveals that for the same Sn content, the inventive sample is effective for minimizing a loss of magnetic properties. Sample Nos. 3-7 and 3-8 show that addition of Ga and In is equally effective.

The grain boundary-forming master alloys used in the inventive samples shown in Table 3 contained $R_6T'_{13}M$, $RT'_2$, $RT'_3$, $RT'_7$, and $R_5T'_{13}$ phases and had a mean grain size of 20 μm. Identification of phases and measurement of a grain size were carried out by SEM-EDX after polishing a section of the alloy.

Example 5

Sample No. 5-1 (Invention)

A primary phase-forming master alloy was prepared by a single roll process. The chill roll used was a copper roll which was rotated at a circumferential speed of 2 m/s. The resulting alloy had a thin ribbon form of 0.3 mm thick and 15 mm wide. The composition of the primary phase-forming master alloy is shown in Table 5.

The master alloy was cut to expose a section including the cooling direction. The section was then polished for imaging under an electron microscope to take a reflection electron image. The photograph indicates the presence of columnar crystal grains having a major axis substantially aligned with the cooling direction or the thickness direction of the thin ribbon. By measuring the diameter of one hundred columnar grains across this section, the mean grain size was determined to be 10 μm. The presence of α-Fe phase was not observed in this master alloy. This master alloy was crushed as in Example 3.

A grain boundary-forming master alloy was prepared and crushed in the same manner as in Example 3. The composition of the grain boundary phase-forming master alloy is shown in Table 5.

Hydrogen Occlusion Treatment Conditions

Mixture temperature: 400° C.

Treating time: 1 hour

Treating atmosphere: hydrogen atmosphere of 0.5 atm.

A jet mill configured as shown in FIG. 2 was used for mechanical pulverization. The mixture was milled until the respective alloy powders reached a mean particle size of 3.5 μm. The subsequent steps were the same as in Example 3. The resulting magnet sample was similarly measured for magnetic properties. The results are shown in Table 5.

Sample No. 5-2 (Invention)

A magnet sample was manufactured by the same procedure as sample No. 5-1 except that a grain boundary-forming master alloy was prepared by a single roll process under the same conditions as the primary phase-forming master alloy of sample No. 5-1. The grain boundary-forming master alloy had a ribbon form of 0.3 mm thick and 15 mm wide. The resulting magnet sample was similarly measured for magnetic properties. The results are shown in Table 5.

Sample No. 5-3 (Invention)

A magnet sample was manufactured by the same procedure as sample No. 5-2 except that upon preparation of a grain boundary-forming master alloy by a single roll process, the circumferential speed of the chill roll was changed to 30 m/s. The resulting magnet sample was similarly measured for magnetic properties. The results are shown in Table 5.

Sample Nos. 5-4 to 5-5 (Comparison)

Magnet-forming master alloys of the composition shown in Table 5 were prepared by a melting or single roll process. The single roll process used the same conditions as inventive sample No. 5-1. Like the inventive samples, the magnet-forming master alloys were crushed, finely milled, compacted, sintered, aged, and magnetized, obtaining magnet samples. These samples were similarly measured for magnetic properties. The results are shown in Table 5.

TABLE 5

| | | Master alloy and Magnet | | Mixing weight | Magnet properties | | | |
|---|---|---|---|---|---|---|---|---|
| No. | Type | Method | Composition (wt %) | ratio | Hcj (kOe) | (BH) max (MGOe) | T (5%) (°C.) | dHcj/dT (%/°C.) |
| 5-1 | P | 1-roll | 24.8Nd-7.2Dy-0.4Al-1.0B-bal.Fe | 100 | | | | |
| | GB | Melting | 50.5Nd-42.5Fe-7.0Sn | 2 | | | | |
| | Magnet | | 25.0Nd-7.0Dy-0.4Al-1.0B-0.1Sn-bal.Fe | | 27 | 37 | 260 | −0.42 |
| 5-2 | P | 1-roll | 24.8Nd-7.2Dy-0.4Al-1.0B-bal.Fe | 100 | | | | |
| | GB | 1-roll | 50.5Nd-42.5Fe-7.0Sn | 2 | | | | |
| | Magnet | | 25.0Nd-7.0Dy-0.4Al-1.0B-0.1Sn-bal.Fe | | 28 | 38 | 270 | −0.41 |
| 5-3 | P | 1-roll | 24.8Nd-7.2Dy-0.4Al-1.0B-bal.Fe | 100 | | | | |
| | GB | 1-roll | 50.5Nd-42.5Fe-7.0Sn(amorphous) | 2 | | | | |
| | Magnet | | 25.0Nd-7.0Dy-0.4Al-1.0B-0.1Sn-bal.Fe | | 28 | 38 | 270 | −0.41 |
| 5-4* | Magnet | Melting | 25.0Nd-7.0Dy-0.4Al-1.0B-0.1Sn-bal.Fe | | 25 | 35 | 250 | −0.43 |
| 5-5* | Magnet | 1-roll | 25.-0Nd-7.0Dy-0.4Al-1.0B-0.1Sn-bal.Fe | | 26 | 36 | 250 | −0.43 |

*comparison
P: primary phase-forming master alloy
GB: grain boundary phase-forming master alloy
1-roll: single roll method The crude powder of grain boundary-forming master alloy and the crude powder of primary phase-forming master alloy were mixed in a nitrogen atmosphere. The mixing proportion (weight ratio) is shown in Table 5.

The mixture was subject to hydrogen occlusion treatment under the following conditions and then to mechanical pulverization without hydrogen release treatment.

The grain boundary-forming master alloys used in the inventive sample Nos. 5-1 and 5-2 contained $R_6T'_{13}M$, $RT'_2$, $RT'_3$, $RT'_7$, and $R_5T'_{13}$ phases. Sample Nos. 5-1 and 5-2 had a mean grain size of 25 μm and 10 μm, respectively. The grain boundary-forming master alloy used in the inventive sample No. 5-3 was amorphous.

As is evident from Table 5, very high values of (BH)max are obtained when primary phase-forming master alloys containing columnar grains having a mean grain size of 3 to 50 μm are used. Thermal stability and magnetic properties are further improved when grain boundary phase-forming master alloys containing grains having a mean grain size of up to 20 μm are used as in sample Nos. 5-2 and 5-3.

It was found that when Fe in the grain boundary-forming master alloy was partially replaced by Ni, the results were equivalent to those of the foregoing examples. When the grain boundary-forming master alloy was annealed at 700° to C. for 20 hours, the proportion of $R_6T'_{13}M$ phase increased. A magnet sample using this master alloy had magnetic properties and thermal stability comparable to those of the inventive samples.

Japanese Patent Application Nos. 5-297300 and 5-302303 are incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for preparing a permanent magnet which contains R, T and B as main ingredients wherein R is at least one element selected from yttrium or rare earth elements, T is iron or a mixture of iron and cobalt, and B is boron and has a primary phase consisting essentially of $R_2T_{14}B$, said method comprising the steps of compacting to obtain a compact a mixture of a primary phase-forming master alloy and a grain boundary phase-forming master alloy both in powder form and sintering the compact, wherein said primary phase-forming master alloy contains 90 to 100% by volume columnar crystal grains consisting essentially of $R_2T_{14}B$ and having a mean grain size of 3 to 50 μm produced by cooling an alloy melt from one direction or two directions., and grain boundaries composed primarily of an R rich phase having an R content higher than $R_2T_{14}B$, said primary phase-forming master alloy consisting essentially of 26 to 32% by weight of R, 0.9 to 2% by weight of B, and the balance of T, said grain boundary phase-forming master alloy is a crystalline alloy consisting essentially of 32 to 60% by weight of R and the balance of cobalt or a mixture of cobalt and iron, and said mixture contains 60 to 95% by weight of said primary phase-forming master alloy.

2. The method of claim 1 wherein the permanent magnet consists essentially of 27 to 32% by weight of R, 1 to 10% by weight of Co, 0.9 to 2% by weight of B, and the balance of Fe.

3. The method of claim 1, comprising producing said primary phase-forming master alloy by cooling an alloy melt from one direction or two opposite directions.

4. The method of claim 3, comprising cooling the alloy melt by a single roll, twin roll or rotary disk process.

5. The method of claim 3 wherein said primary phase-forming master alloy as cooled has a thickness of 0.1 to 2 mm in the cooling direction.

6. The method of claim 1 wherein said primary phase-forming master alloy is substantially free of an α-Fe phase.

7. The method of claim 1 wherein said grain boundary phase-forming master alloy contains grains having a mean grain size of 0.1 to 20 μm.

8. The method of claim 1, comprising producing said grain boundary phase-forming master alloy by cooling an alloy melt from one direction or two opposite directions.

9. The method of claim 8, comprising cooling the alloy melt by a single roll, twin roll or rotary disk process.

10. The method of claim 8 wherein said grain boundary phase-forming master alloy as cooled has a thickness of 0.1 to 2 mm in the cooling direction.

11. The method of claim 1 wherein in said mixture, both said primary phase-forming master alloy and said grain boundary phase-forming master alloy in powder form have a mean particle size of 1 to 10 μm.

12. The method of claim 1, comprising producing said primary phase-forming master alloy in powder form by causing the alloy to occlude hydrogen and pulverizing the alloy by a jet mill.

13. The method of claim 1, comprising producing said grain boundary phase-forming master alloy in powder form by causing the alloy to occlude hydrogen and pulverizing the alloy by a jet mill.

14. The method of claim 12 or 13, comprising heating the alloy to a temperature of 300° to 600° C., then subjecting said alloy to hydrogen occlusion treatment, and then pulverizing said alloy without hydrogen release.

15. The method of claim 12 or 13, comprising following the hydrogen occlusion by hydrogen release.

16. The method of claim 1, comprising obtaining said mixture by mixing the primary phase-forming master alloy and the grain boundary phase-forming master alloy, crushing the mixture, causing the mixture to occlude hydrogen, and milling the mixture by a jet mill.

17. The method of claim 1, comprising obtaining said mixture by independently crushing the primary phase-forming master alloy and the grain boundary phase-forming master alloy, mixing the crushed alloys, causing the mixture to occlude hydrogen, and milling the mixture by a jet mill.

18. The method of claim 1, comprising obtaining said mixture by independently crushing the primary phase-forming master alloy ad the grain boundary phase-forming master alloy, independently causing the crushed alloys to occlude hydrogen, independently milling the alloys by a jet mill, and mixing the alloy powders.

19. A method for preparing a permanent magnet which contains R, T and B as main ingredients wherein R is at least one element selected from the group consisting of yttrium and rare earth elements, T is iron or a mixture of iron and at least one of cobalt and nickel, and B is boron and has a primary phase consisting essentially of $R_2T_{14}B$, said method comprising the steps of compacting to obtain a compact mixture of a primary phase-forming master alloy and a grain boundary-forming master alloy both in powder form and sintering the compact, wherein said primary phase-forming master alloy has a primary phase containing columnar crystal grains consisting essentially of $R_2T_{14}B$ having a mean grain size of 3 to 50 μm and grain boundaries composed mainly of an R rich phase having a higher R content than $R_2T_{14}B$, and said grain boundary-forming master alloy contains 40 to 65% by weight of R, 30 to 60% by weight of T' and 1 to 12% by weight of M wherein T' is at least one element selected from the group consisting of iron, cobalt and nickel and M is at least one element selected from the group consisting of tin, indium and gallium.

20. The method of claim 19 wherein M contains 30 to 100% by weight of tin.

21. The method of claim 19 wherein said grain boundary-forming master alloy has an $R_6T'_{13}M$ phase.

22. The method of claim 19 wherein said mixture contains 0.2 to 10% by weight of said grain boundary-forming master alloy.

23. The method of claim 19 wherein the permanent magnet consists essentially of 27 to 38% by weight of R, 0.5 to 4.5% by weight of B, 0.03 to 0.5% by weight of M, and 51 to 72% by weight of T.

24. The method of claim 19 wherein the permanent magnet contains an $R_6T'_{13}M$ phase in the grain boundary.

25. The method of claim 19, comprising producing said primary phase-forming master alloy by cooling an alloy melt from one direction or two opposite directions.

26. The method of claim 25, comprising cooling the alloy melt by a single roll, twin roll or rotary disk process.

27. The method of claim 25 wherein said primary phase-forming master alloy as cooled has a thickness of 0.1 to 2 mm in the cooling direction.

28. The method of claim 19 wherein said primary phase-forming master alloy is substantially free of an α-Fe phase.

29. The method of claim 19 wherein said grain boundary phase-forming master alloy contains grains having a mean grain size of up to 20 μm.

30. The method of claim 19, comprising producing said grain boundary phase-forming master alloy by cooling an alloy melt from one direction or two opposite directions.

31. The method of claim 30, comprising cooling the alloy melt by a single roll, twin roll or rotary disk process.

32. The method of claim 30 wherein said grain boundary phase-forming master alloy as cooled has a thickness of 0.1 to 2 mm in the cooling direction.

33. The method of claim 19, comprising producing said primary phase-forming master alloy in powder form by causing the alloy to occlude hydrogen and pulverizing the alloy by a jet mill.

34. The method of claim 19, comprising producing said grain boundary phase-forming master alloy in powder form by causing the alloy to occlude hydrogen and pulverizing the alloy by a jet mill.

35. The method of claim 33 or 34, comprising heating the alloy to a temperature of 300° to 600° C., then subjecting said alloy to hydrogen occlusion treatment, and then pulverized said alloy without hydrogen release.

36. The method of claim 33 or 34, comprising following the hydrogen occlusion by hydrogen release.

37. The method of claim 1, wherein said columnar crystal grains have a major axis length to width ratio of 21 to 50/1.

38. The method of claim 19, wherein said columnar crystal grains have a major axis length to width ratio of 2/1 to 50/1.

* * * * *

UNITED STATES PATENT AND TRADEMARK OFFICE
CERTIFICATE OF CORRECTION

PATENT NO. : 5,595,608

DATED : January 21, 1997

INVENTOR(S) : Katashi TAKEBUCHI, et al.

It is certified that error appears in the above-identified patent and that said Letters Patent is hereby corrected as shown below:

Column 33, line 34, "two directions.," should read
--two directions,--.

Column 36, line 21, "21 to 50/1." should read
--2/1 to 50/1.--.

Signed and Sealed this

Sixteenth Day of December, 1997

Bruce Lehman

*Attest:*

BRUCE LEHMAN

*Attesting Officer*

*Commissioner of Patents and Trademarks*